US010099264B2

(12) United States Patent
Fernholz et al.

(10) Patent No.: US 10,099,264 B2
(45) Date of Patent: Oct. 16, 2018

(54) BUBBLE ENHANCED CLEANING METHOD AND CHEMISTRY

(75) Inventors: Peter J. Fernholz, Burnsville, MN (US); Anthony W. Erickson, Golden Valley, MN (US)

(73) Assignee: Ecolab USA Inc., St. Paul, MN (US)

( * ) Notice: Subject to any disclaimer, the term of this patent is extended or adjusted under 35 U.S.C. 154(b) by 0 days.

(21) Appl. No.: 12/069,494

(22) Filed: Feb. 11, 2008

(65) Prior Publication Data

US 2009/0199875 A1 Aug. 13, 2009

(51) Int. Cl.

| | |
|---|---|
| ***B08B 3/00*** | (2006.01) |
| ***B08B 7/00*** | (2006.01) |
| ***C11D 3/00*** | (2006.01) |
| ***C11D 11/00*** | (2006.01) |
| ***C11D 3/395*** | (2006.01) |
| ***C11D 7/12*** | (2006.01) |
| ***B08B 3/08*** | (2006.01) |
| ***B08B 3/10*** | (2006.01) |

(52) U.S. Cl.

CPC ..... *B08B 7/00* (2013.01); *B08B 3/08* (2013.01); *B08B 3/10* (2013.01); *C11D 3/0052* (2013.01); *C11D 3/3956* (2013.01); *C11D 7/12* (2013.01); *C11D 11/0041* (2013.01); *C11D 11/0064* (2013.01)

(58) Field of Classification Search

CPC ..... B08B 7/00; C11D 3/0052; C11D 3/3956; C11D 7/12; C11D 11/0041; C11D 11/0064

USPC ..... 426/312, 474; 510/111, 218, 223, 228, 510/229, 233, 434, 477, 478, 488, 495, 510/509, 510; 134/2, 3, 25.1, 25.2, 25.3, 134/26, 7, 28, 29, 30, 31, 36, 41, 42

See application file for complete search history.

(56) References Cited

U.S. PATENT DOCUMENTS

| | | | |
|---|---|---|---|
| 4,219,333 | A | 8/1980 | Harris |
| 4,806,277 | A | 2/1989 | Sakurai et al. |
| 5,244,468 | A | 9/1993 | Harris et al. |

(Continued)

FOREIGN PATENT DOCUMENTS

| | | |
|---|---|---|
| EP | 1170567 A1 | 1/2002 |
| JP | 62087206 | 4/1987 |

(Continued)

OTHER PUBLICATIONS

Fernholz, Peter J., "Environmentally Friendly CIP Methods and Chemistry with Enhanced Cleaning Performance for Brew House and Fermentation Tanks", presented in Asia Pacific International Brewing and Distillation Conference, Auckland, NZ from Apr. 6-10, 2008, 15 pages.

(Continued)

*Primary Examiner* — Bibi Sharidan Carrillo

(74) *Attorney, Agent, or Firm* — Merchant & Gould P.C.

(57) ABSTRACT

A method of cleaning equipment such as heat exchangers, evaporators, tanks and other industrial equipment using clean-in-place procedures comprising applying a pre-treatment solution prior to the application of an override use solution. A gas generating use solution is present in either the pretreatment or the override use solution. The gas generating use solution is capable of releasing gas on and in a soil, resulting in a soil disruption effect and enhanced cleaning.

11 Claims, 26 Drawing Sheets
(26 of 26 Drawing Sheet(s) Filed in Color)

(56) References Cited

U.S. PATENT DOCUMENTS

| | | | | |
|---|---|---|---|---|
| 5,593,091 | A | 1/1997 | Harris | |
| 6,203,691 | B1 | 3/2001 | Hoffman, Jr. et al. | |
| 6,313,086 | B1 * | 11/2001 | Askew et al. | 510/478 |
| 6,455,017 | B1 | 9/2002 | Kasting, Jr. et al. | |
| 6,638,900 | B2 | 10/2003 | Ajmani et al. | |
| 7,252,096 | B2 | 8/2007 | Gill et al. | |
| 2003/0114340 | A1 | 6/2003 | Ajmani et al. | |
| 2004/0005992 | A1 | 1/2004 | Ebberts et al. | |
| 2005/0130868 | A1 | 6/2005 | Evans et al. | |
| 2005/0150520 | A1 | 7/2005 | Gill et al. | |
| 2005/0194022 | A1 | 9/2005 | Schwartz | |
| 2006/0005316 | A1 | 1/2006 | Durrant | |
| 2006/0276366 | A1 * | 12/2006 | Deljosevic et al. | 510/302 |
| 2007/0000067 | A1 | 1/2007 | Shi et al. | |
| 2007/0037729 | A1 * | 2/2007 | Mathur | 510/507 |
| 2007/0203047 | A1 * | 8/2007 | Pegelow et al. | 510/421 |
| 2007/0232517 | A1 * | 10/2007 | Evans et al. | 510/445 |
| 2008/0096784 | A1 * | 4/2008 | Barg et al. | 510/161 |

FOREIGN PATENT DOCUMENTS

| | | |
|---|---|---|
| JP | 6179991 | 6/1994 |
| JP | 7080425 | 3/1995 |
| JP | 8112574 | 5/1996 |
| JP | 09-234438 | 9/1997 |
| JP | 9279371 | 10/1997 |
| JP | 10-094768 | 4/1998 |
| JP | 1088190 | 4/1998 |
| JP | 2000-325903 | 11/2000 |
| JP | 2001009401 | 1/2001 |

OTHER PUBLICATIONS

Supplemental European Search Report for European Patent Application No. EP09709720, Gill, et al., Date of completion of the search Jun. 25, 2013., Jun. 25, 2013.

Bond, Annie B. Washing Soda to Unclog Drains. Care2, Mar. 25, 1999 [retrieved 2016], Retrieved from the Internet: <URL: http://www.care2.com/greenliving/clogged-drain.html>.

Quilty, David. Naturally Unclog a Drain with Vinegar, Baking Soda and Water. The Good Human, Mar. 21, 2007 [retrieved 2016]. Retrieved from the Internet: <URL: http://thegoodhuman.com/2007/03/21/naturally-unclog-a-drain/>.

Canadian Search Report for Canadian Application No. 2,711,232, dated Oct. 19, 2015.

* cited by examiner

Left: 1% Sodium Bicarbonate with 2% AC-55-5 Override

Right: 2% AC-55-5

Left: 1% Sodium Bicarbonate, 0.5% Propylene Carbonate with 2% AC-55-5 Override

Right: 2% AC-55-5

Left: 1% Sodium Bicarbonate with 2% AC-55-5 Override

Right: 1.5% NaOH

Stillage soil screens before treatment.

20 minutes total clean time

Left: 1% Sodium Bicarbonate with 2% AC-55-5 Override

Right: 2% AC-55-5

25 minutes total clean time

Left: 1% Sodium Bicarbonate with 2% AC-55-5 Override

Right: 2% AC-55-5

Left: 1% Sodium Bicarbonate with 2% AC-55-5 Override

Right: 1%NaOH

Left: 1% $NaHCO_3$, 2% AC-55-5 override

Right: 1.5% NaOH

Left: 1% $NaHCO_3$, 2% AC-55-5 override

Right: 1.5% NaOH

Sample 3: sodium bicarbonate pretreatment with 2% Acid override, with stirring

Sample 4: sodium bicarbonate pretreatment with 2% Acid override, with no stirring Sample 1: Air diffuser Sample 2: Denture Cleaner Bubble action toilet bowl cleaner 1% Sodium Bicarbonate pretreatment with 2% AC-55-5 override Tank after cleaning Tank before cleaning

BUBBLE ENHANCED CLEANING METHOD AND CHEMISTRY

FIELD

The present disclosure relates to methods for removing soils from hard surfaces by generating a gas or gases on and in the soil to be removed.

BACKGROUND

In many industrial applications, such as the manufacture of foods and beverages, hard surfaces commonly become contaminated with soils such as carbohydrate, proteinaceous, and hardness soils, food oil soils, fat soils, and other soils. Such soils can arise from the manufacture of both liquid and solid foodstuffs. Carbohydrate soils, such as cellulosics, monosaccharides, disaccharides, oligosaccharides, starches, gums and other complex materials, when dried, can form tough, hard to remove soils, particularly when combined with other soil components such as proteins, fats, oils, minerals, and others. The removal of such carbohydrate soils can be a significant problem. Similarly, other materials such as proteins, fats and oils can also form hard to remove soil and residues.

Food and beverage soils are particularly tenacious when they are heated during processing. Foods and beverages are heated for a variety of reasons during processing. For example, in dairy plants, dairy products are heated on a pasteurizer (e.g. HTST—high temperature short time pasteurizer or UHT—ultra high temperature pasteurizer) in order to pasteurize the dairy product. Also, many food and beverage products are concentrated or created as a result of evaporation.

Specific examples of food and beverage products that are concentrated using evaporators include dairy products such as whole and skimmed milk, condensed milk, whey and whey derivatives, buttermilk, proteins, lactose solutions, and lactic acid; protein solutions such as soya whey, nutrient yeast and fodder yeast, and whole egg; fruit juices such as orange and other citrus juices, apple juice and other pomaceous juices, red berry juice, coconut milk, and tropical fruit juices; vegetable juices such as tomato juice, beetroot juice, carrot juice, and grass juice; starch products such as glucose, dextrose, fructose, isomerose, maltose, starch syrup, and dextrine; sugars such as liquid sugar, white refined sugar, sweetwater, and inulin; extracts such as coffee and tea extracts, hop extract, malt extract, yeast extract, pectin, and meat and bone extracts; hydrolyzates such as whey hydrolyzate, soup seasonings, milk hydrolyzate, and protein hydrolyzate; beer such as de-alcoholized beer and wort; and baby food, egg whites, bean oils, and fermented liquors.

Clean-in-place cleaning techniques are a specific cleaning regimen adapted for removing soils from the internal components of tanks, lines, pumps and other process equipment used for processing typically liquid product streams such as beverages, milk, juices, etc. Clean-in-place cleaning involves passing cleaning solutions through the system without dismantling any system components. The minimum clean-in-place technique involves passing the cleaning solution through the equipment and then resuming normal processing. Any product contaminated by cleaner residue can be discarded. Often clean-in-place methods involve a first rinse, the application of the cleaning solutions, and a second rinse with potable water followed by resumed operations. The process can also include any other contacting step in which a rinse, acidic or basic functional fluid, solvent or other cleaning component such as hot water, cold water, etc. can be contacted with the equipment at any step during the process. Often the final potable water rinse is skipped in order to prevent contamination of the equipment with bacteria following the cleaning and/or sanitizing step.

Conventional clean-in-place techniques however are not always sufficient at removing all types of soils. Specifically, it has been found that low density organic soils, e.g., ketchup, barbeque sauce, are not easily removed using traditional CIP cleaning techniques. Thermally degraded soils are also particularly difficult to remove using conventional CIP techniques.

Brewery soils are another type of soil that is particularly difficult to remove from a surface. Brewing beer requires the fermentation of sugars derived from starch-based material e.g., malted barley. Fermentation uses yeast to turn the sugars in wort to alcohol and carbon dioxide. During fermentation, the wort becomes beer. Once the boiled wort is cooled and in a fermenter, yeast is propagated in the wort and it is left to ferment, which requires a week to months depending on the type of yeast and strength of the beer. In addition to producing alcohol, fine particulate matter suspended in the wort settles during fermentation. Once fermentation is complete, the yeast also settles, leaving the beer clear, but the fermentation tanks soiled.

Fermentation is sometimes carried out in two stages, primary and secondary. Once most of the alcohol has been produced during primary fermentation, the beer is transferred to a new vessel and allowed a period of secondary fermentation. Secondary fermentation is used when the beer requires long storage before packaging or greater clarity.

Often during the fermentation process in commercial brewing, the fermentation tanks develop a ring of soil, i.e., brandhefe ring, which is particularly difficult to remove. Traditional CIP methods of cleaning these tanks do not always remove this soil. Thus, brewers often resort to climbing inside of the tanks and manually scrubbing them to remove the soil.

What is needed therefore is an improved method for removing these types of soils that are not easily removed using conventional cleaning techniques. It is against this background that the present invention has been made.

SUMMARY OF THE DISCLOSURE

The present invention provides methods for removing soils from surfaces comprising applying a pre-treatment solution followed by an override use solution, wherein there is no rinse between these steps. A gas generating use solution is present in either the pre-treatment or the override use solutions. The gas generating use solution is capable of producing carbon dioxide gas or another gas, and provides for a soil disruption effect. The combination of pre-treatment and override, along with the soil disruption effect provides for enhanced soil removal compared to conventional cleaning techniques.

Accordingly in one aspect, the present invention provides a method for removing soil from a surface using a CIP process. The method comprises applying a pretreatment solution comprising a gas generating use solution to the surface for an amount of time sufficient to allow the pretreatment solution to penetrate the soil. An override use solution is then applied to the surface. The application of the override use solution activates the pre-treatment solution to generate gas on and in the soil. The gas is generated in an amount sufficient to provide a soil disruption effect which substantially removes the soil from the surface by loosening the soil from the surface, and breaking up the soil cake. The loosened soil can be easily washed away as the override solution contacts the surface. Also, the loosened soil can be easily washed away during a rinse step after the override use solution has been applied. There is no rinse step between the application of the pretreatment solution and the override use solution.

In some embodiments, the soil comprises a thermally degraded soil. In other embodiments, the soil comprises a high density organic soil. In yet other embodiments, the soil is selected from the group consisting of a tomato based food soil, a food soil containing high levels of reducing sugars, and brewery soils.

In some embodiments, the surface to be cleaned is selected from the group consisting of tanks, lines and processing equipment. In some embodiments, the processing equipment cleaned is selected from the group consisting of a pasteurizer, a homogenizer, a separator, an evaporator, a filter, a dryer, a membrane, a fermentation tank and a cooling tower. In other embodiments, the processing equipment is selected from the group consisting of processing equipment used in the dairy, cheese, brewing, beverage, food, biofuel, sugar, and pharmaceutical manufacturing industries. In still yet other embodiments, the surface is selected from the group consisting of floors, walls, dishes, flatware, pots and pans, heat exchange coils, ovens, fryers, smoke houses, sewer drain lines, and vehicles.

In some embodiments, the gas generating solution comprises an aqueous solution comprising a carbon dioxide producing salt. The carbon dioxide producing salt comprises a carbonate salt, bicarbonate salt, percarbonate salt, a sesquicarbonate salt, and mixtures thereof in some embodiments. In some embodiments, the carbonate salt is selected from the group consisting of sodium carbonate, potassium carbonate, lithium carbonate, ammonium carbonate, calcium carbonate, magnesium carbonate, propylene carbonate and mixtures thereof. In other embodiments, the concentration of the carbonate salt in solution is about 0.2 wt % to about 3.0 wt %.

In some embodiments, the bicarbonate salt is selected from the group consisting of sodium bicarbonate, potassium bicarbonate, ammonium bicarbonate, and mixtures thereof. In other embodiments, the percarbonate salt is selected from the group consisting of sodium percarbonate, lithium percarbonate, potassium percarbonate, and mixtures thereof. In still yet other embodiments, the sesquicarbonate salt is selected from the group consisting of sodium sesquicarbonate, potassium sesquicarbonate, lithium sesquicarbonate, and mixtures thereof.

In some embodiments, the override use solution applied to the surface comprises an acid. In some embodiments, the acid is selected from the group consisting of phosphoric acid, nitric acid, hydrochloric acid, sulfuric acid, acetic acid, citric acid, lactic acid, formic acid, glycolic acid, sulfamic acid, methanesulfonic acid and mixtures and derivatives thereof. In some embodiments, the concentration of the acid is about 1 wt % to about 3 wt %. In other embodiments, the override use solution lowers the pH to less than about 7.5.

In some embodiments, the pretreatment solution is applied to the surface for about 1 to about 20 minutes. In other embodiments, the pretreatment solution is applied to the surface for about 10 minutes. In some embodiments, the pretreatment and override solutions are applied at a temperature of between about 2° C. to about 50° C.

In some aspects, the present invention provides a method for removing soil from a surface using a CIP process, said method comprising applying a pretreatment solution to the surface for an amount of time sufficient to allow the pretreatment solution to penetrate the soil. An override use solution comprising a gas generating use solution is then applied to the surface. The application of the override use solution activates the pre-treatment solution to generate gas on and in the soil breaking up the soil. The surface is then rinsed.

These and other embodiments will be apparent to these of skill in the art and others in view of the following detailed description. It should be understood, however, that this summary and the detailed description illustrate only some examples, and are not intended to be limiting to the invention as claimed.

BRIEF DESCRIPTION OF THE DRAWINGS

The patent or application file contains at least one drawing executed in color. Copies of this patent or patent application publication with color drawings will be provided by the Office upon request and payment of the necessary fee.

DETAILED DESCRIPTION OF THE INVENTION

Figure 1:
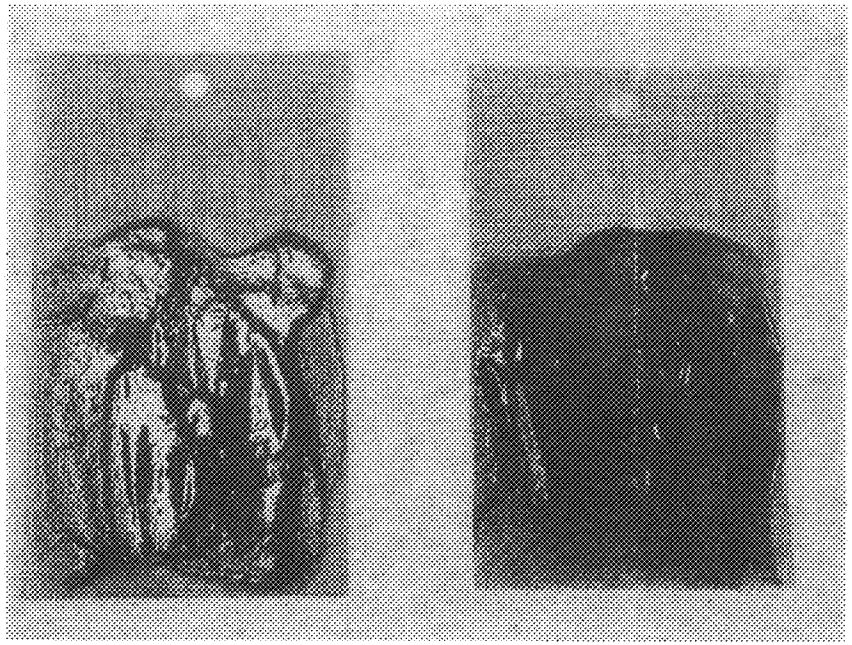
FIG. 1 is a photograph showing two stainless steel screens soiled with a thermally degraded, high density organic soil prior to cleaning.

In some aspects, the present invention is directed to methods for cleaning and removing soils from hard surfaces using a CIP process, wherein the soils are not easily cleaned using conventional CIP techniques. In some embodiments, the method comprises applying a pretreatment use solution to the surface to be cleaned, followed by application of an override use solution. A gas generating use solution is present in the pretreatment use solution, and/or in the override use solution. The gas generating use solution provides a soil disruption effect, and enhances cleaning and soil removal. The gas generating use solution can provide additional benefits as well, e.g., flavor destruction and antimicrobial effects.

So that the invention may be more readily understood, certain terms are first defined.

As used herein, the term "active ingredients," refers to the non-inert ingredients included in the pretreatment use solution and/or in the override use solution that facilitate and/or enhance the removal of soil from the surface to be cleaned.

As used herein, "weight percent," "wt-%," "percent by weight," "% by weight," and variations thereof refer to the concentration of a substance as the weight of that substance divided by the total weight of the composition and multiplied by 100. It is understood that, as used here, "percent," "%," and the like are intended to be synonymous with "weight percent," "wt-%," etc.

As used herein, the term "about" refers to variation in the numerical quantity that can occur, for example, through typical measuring and liquid handling procedures used for making concentrates or use solutions in the real world; through inadvertent error in these procedures; through differences in the manufacture, source, or purity of the ingredients used to make the compositions or carry out the methods; and the like. The term "about" also encompasses amounts that differ due to different equilibrium conditions for a composition resulting from a particular initial mixture. Whether or not modified by the term "about", the claims include equivalents to the quantities.

It should be noted that, as used in this specification and the appended claims, the singular forms "a," "an" and "the" include plural referents unless the content clearly dictates otherwise. Thus, for example, reference to a composition containing "a compound" includes having two or more compounds. It should also be noted that the term "or" is generally employed in its sense including "and/or" unless the content clearly dictates otherwise.

In some aspects, the methods of the present invention apply to equipment generally cleaned using clean-in-place (i.e., CIP) cleaning procedures. Examples of such equipment include evaporators, heat exchangers (including tube-in-tube exchangers, direct steam injection, and plate-in-frame exchangers), heating coils (including steam, flame or heat transfer fluid heated) re-crystallizers, pan crystallizers, spray dryers, drum dryers, and tanks.

The methods of the present invention can be used generally in any application where thermally degraded soils, i.e., caked on soils or burned on soils, such as proteins or carbohydrates, need to be removed. As used herein, the term "thermally degraded soil" refers to a soil or soils that have been exposed to heat and as a result have become baked on to the surface to be cleaned. Exemplary thermally degraded soils include food soils that have been heated during processing, e.g., dairy products heated on pasteurizers. The methods of the present invention are especially effective at removing thermally degraded soils containing high levels of reducing sugars, e.g., fructose, corn syrup.

The methods of the present invention can also be used to remove other non-thermally degraded soils that are not easily removed using conventional cleaning techniques. The methods of the present invention provide enhanced cleaning of these hard to remove soil types. Soil types best suited to cleaning with the methods of the present invention include, but are not limited to, starch, cellulosic fiber, protein, simple carbohydrates and combinations of any of these soil types with mineral complexes. Examples of specific food soils that are effectively removed using the methods of the present invention included, but are not limited to, vegetable and fruit juices, brewing and fermentation residues, soils generated in sugar beet and cane processing, and soils generated in condiment and sauce manufacture, e.g., ketchup, tomato sauce, barbeque sauce. These soils can develop on heat exchange equipment surfaces and on other surfaces during the manufacturing and packaging process.

Exemplary industries in which the methods of the present invention can be used include, but are not limited to: the food and beverage industry, e.g., the dairy, cheese, sugar, and brewery industries; oil processing industry; industrial agriculture and ethanol processing; and the pharmaceutical manufacturing industry.

Conventional CIP processing is generally well-known. The process includes applying a dilute solution (typically about 0.5-3%) onto the surface to be cleaned. The solution flows across the surface (3 to 6 feet/second), slowly removing the soil. Either new solution is re-applied to the surface, or the same solution is recirculated and re-applied to the surface.

A typical CIP process to remove a soil (including organic, inorganic or a mixture of the two components) includes at least three steps: an alkaline solution wash, an acid solution wash, and then a fresh water rinse. The alkaline solution softens the soils and removes the organic alkaline soluble soils. The subsequent acid solution removes mineral soils left behind by the alkaline cleaning step. The strength of the alkaline and acid solutions and the duration of the cleaning steps are typically dependent on the durability of the soil. The water rinse removes any residual solution and soils, and cleans the surface prior to the equipment being returned on-line.

Unlike traditional CIP cleaning techniques, the methods of the present invention comprise a pre-treatment step which penetrates the soils. An override use solution applied to the surface after the pre-treatment step activates the pre-treatment chemistry that has penetrated the soil. The combination of pre-treatment and override chemistries with a gas generating use solution present in either, results in the generation of gas on and in the soil, providing a soil disruption effect. This soil disruption effect has been found to facilitate and enhance the cleaning of these types of soils compared with conventional cleaning techniques.

Gas Generating Use Solutions

In some aspects of the present invention, a gas generating use solution is present in the pre-treatment and/or the override use solution. As used herein, the term "gas generating use solution," refers to a use solution that is capable of generating a gas, e.g., carbon dioxide, on and in the soil to be removed. In some embodiments, the gas generating use solution is capable of producing carbon dioxide gas on and in the soil to be removed. In other embodiments, the gas generating use solution is capable of producing a gas other than carbon dioxide on and in the soil. Exemplary gases other than carbon dioxide that can be generated in accordance with the methods of the present invention include, but are not limited to, chlorine dioxide, chlorine, oxygen. Gas generating use solutions for use with the methods of the present invention can include any solution that produces a gas capable of facilitating and enhancing soil removal, or having another positive effect on the surface to be cleaned, e.g., flavor destruction, and/or antimicrobial effects.

In some embodiments, a carbon dioxide gas generating use solution is applied to the surface to be cleaned. The carbon dioxide gas generating use solution can be a use solution that comprises a carbonate salt, bicarbonate salt, percarbonate salt, sesquicarbonate salt, and/or mixtures thereof. Examples of carbonate salts for use with the methods of the present invention include, but are not limited to, sodium carbonate, potassium carbonate, lithium carbonate, ammonium carbonate, magnesium carbonate, calcium carbonate, propylene carbonate and mixtures thereof. Examples of bicarbonate salts for use with the methods of the present invention include, but are not limited to, sodium bicarbonate, potassium bicarbonate, lithium bicarbonate, ammonium bicarbonate, magnesium bicarbonate, calcium bicarbonate, and mixtures thereof. Examples of sesquicarbonate salts for use with the methods of the present invention include, but are not limited to, sodium sesquicarbonate, potassium sesquicarbonate, lithium sesquicarbonate, and mixtures thereof.

In other embodiments, a non-carbon dioxide gas generating use solution is used. For example, in some embodiments, the gas generating use solution produces a chlorine containing gas, e.g., chlorine dioxide. The chlorine containing gas can be generated in situ on and in the soil, for example, by reaction of sodium hypochlorite with an acid. Any gas generating use solution capable of generating gas in situ on and in the soil can be used with the methods of the present invention.

In some embodiments, the gas generating use solution produces more than one type of gas on and in the soil. For example, the gas generating use solution can be capable of producing carbon dioxide on and in the soil, as well as chlorine gas. This can be achieved in numerous ways. For example, in some embodiments, the pre-treatment use solution can comprise a carbonate salt as well as sodium chlorite. When activated by an override use solution comprising an acid, both carbon dioxide and chlorine dioxide will be generated on and in the soil.

In addition to enhancing soil removal from the surface, the selected gas generating use solution can have additional benefits as well. For example, if chlorine gas or chlorine dioxide is generated in situ on and in the soil, the gas can have antimicrobial properties. Additionally, when used to clean a surface in the food and beverage industry, the gas generated may also have a flavor destruction effect, i.e., generation of gas on and in the soil, and on the surface destroys any residual flavors on the surface.

The amount of gas generating use solution present in either the pre-treatment or override use solution is dependent on many factors including, but not limited to, the amount of soiling, the type of soil, and the surface to be cleaned. In some embodiments, about 0.1% to about 5% of a gas generating use solution is present in either the pretreatment or override use solution. It is to be understood that all values and ranges between these values are encompassed by the present invention. In some embodiments, the gas generating use solution comprises about 1% carbonate or bicarbonate use solution.

In some embodiments, the gas generating use solution is activated, e.g., gas is generated, by a reaction between the gas generating use solution and an acid. Any acid suitable for use on the surface to be cleaned that will activate the gas generating use solution can be used with the methods of the present invention. Exemplary acids include, but are not limited to, phosphoric acid, nitric acid, hydrochloric acid, sulfuric acid, acetic acid, citric acid, lactic acid, formic acid, glycolic acid, methane sulfonic acid, sulfamic acid, and mixtures thereof. The amount and type of acid present in the pre-treatment or override use solution is dependent on many factors, including, but not limited to, the amount of soiling, the type of soil, the surface to be cleaned, and the composition of the gas generating use solution to be used. In some embodiments, about 0.05% to about 7.0% acid is present in the pretreatment or override use solutions. It is to be understood that all values and ranges between these values are to be encompassed by the invention. In some embodiments, about 1%, about 2%, or about 3% of acid is present in the pre-treatment or override use solutions. Preferably about 2% acid is present.

Pre-Treatment Use Solutions

In some aspects of the methods of the present invention a pretreatment use solution is applied to the surface to be cleaned. The chemistry of the pre-treatment solution is selected to facilitate removal of the soils on the surfaces to be cleaned. The pre-treatment solution pre-coats and penetrates into the soil. The specific chemistry used can be selected based on a variety of factors including, but not limited to, the type of soil to be removed, the surface to be cleaned and the override use solution to be applied.

In some embodiments, the pre-treatment solution comprises about 0.01% to about 10.0% of active ingredients. In some embodiments, the pre-treatment solution comprises at about 0.5%, about 1%, about 2%, or about 3% of active ingredients. It is to be understood that all values and ranges between these values are encompassed by the methods of the present invention.

In some embodiments, the active ingredient in the pre-treatment use solution comprises a gas generating use solution. When a gas generating use solution is present in the pre-treatment use solution, the solution can be activated, i.e., gas generated, by the addition of an override use solution, e.g., an override use solution comprising an acid. For example, the pre-treatment use solution can comprise a carbon dioxide gas generating use solution, e.g., a use solution comprising a carbonate salt, and/or a non-carbon dioxide gas generating use solution as an active ingredient, e.g., a chlorine dioxide gas generating use solution.

Although when present in the pre-treatment use solution the gas generating use solution can produce some gas upon initial contact with the soil, the majority of the gas evolved occurs upon activation of the gas generating use solution with the override use solution. Without wishing to be bound by any particular theory, it is thought that the initial gas generation is due to the reaction between any acids in the soils and the gas generating use solution. The initial gas generation is not enough to cause the necessary soil disruption required for effective soil removal.

Override Use Solutions

In some aspects of the present invention, an override use solution is applied to the surface to be cleaned after a pre-treatment use solution has been applied to the surface. In some embodiments, the override use solution is added to the pre-treatment use solution without first draining or rinsing the pre-treatment solution from the surface or system being cleaned. The chemistry of the override use solution is selected to facilitate removal of the soils on the surfaces to be cleaned. The specific chemistry used can be selected, for example, based on the soil to be removed, the surface to be cleaned, as well as the chemistry of the pre-treatment use solution selected.

In some embodiments, there is no rinse step between the application of the pre-treatment use solution, and the application of the override use solution. In some embodiments, there is a rinse step between the application of the pre-treatment use solution and the application of the override use solution. In some embodiments, a pH adjusting agent is applied in between the application of the pre-treatment use solution and the override use solution.

In some aspects of the present invention, the override use solution interacts with the pre-treatment use solution that remains on and in the soil to generate gas. The gas generated on and in the soil produces a soil disruption effect. As used herein, the term "soil disruption" or "soil disruption effect," refers to the loosening and displacement of soil from a surface after treatment according to the methods of the present invention. Without wishing to be bound by any particular theory, it is thought that the pre-treatment use solution penetrates into the soil to be removed. An override use solution is then applied to the soil. Either the pre-treatment or the override use solution comprises a gas generating use solution as at least one active ingredient. The pre-treatment solution in the soil reacts with the override solution and gas begins to evolve. The gas "bubbles" disrupt the soil matrix, breaking up the soil cake, and loosening it from the surface. This disruption effect alone results in cleaning, or can provide easier cleaning for subsequent wash and/or rinse steps. In some embodiments, the loosened soil can then rinsed away from the surface by another wash, or a rinse step, for example.

For example, in some embodiments, an override use solution comprising a carbon dioxide gas generating use solution, e.g., a solution comprising a carbonate salt, is applied to the surface to be cleaned. When a gas generating use solution is applied to the surface to be cleaned as part of the override use solution, the pre-treatment use solution selected is one such that when the override use solution is applied to the surface, gas is generated on and in the soil. In some embodiments, a pre-treatment use solution comprising an acid will be applied to the surface to be cleaned prior to the application of the override use solution comprising a gas generating solution.

In some embodiments, the override use solution comprises about 0.01% to about 10.0% of active ingredients. In some embodiments, the override use solution comprises at about 0.5%, about 1%, about 2%, or about 3% of active ingredients. It is to be understood that all values and ranges between these values are encompassed by the methods of the present invention. In some embodiments, the active ingredients in the override use solution include, but are not limited to, an acid, and/or a gas generating solution.

Additional Components

In other embodiments, additional components may be present in the pre-treatment and/or override use solutions. For example, the pre-treatment and/or override use solutions can include: any alkaline/base; penetrant, e.g., surfactants, solvents; and/or builder. In most embodiments, water is the remainder of the solution.

Penetrants

A penetrant can be present in the pre-treatment and/or override use solution. Preferably, the penetrant is water miscible.

Examples of suitable penetrants include alcohols, short chain ethoxylated alcohols and phenol (having 1-6 ethoxylate groups). Organic solvents are also suitable penetrants. Examples of suitable organic solvents, for use as a penetrant, include esters, ethers, ketones, amines, and nitrated and chlorinated hydrocarbons.

Another preferred class of penetrants is ethoxylated alcohols. Examples of ethoxylated alcohols include alky, aryl, and alkylaryl alkoxylates. These alkoxylates can be further modified by capping with chlorine-, bromine-, benzyl-, methyl-, ethyl-, propyl-, butyl- and alkyl-groups. A preferred level of ethoxylated alcohols in the solution is about 0.01 to about 0.5 wt-%.

Another class of penetrants is fatty acids. Some non-limiting examples of fatty acids are $C_6$ to $C_{12}$ straight or branched fatty acids. Preferred fatty acids are liquid at room temperature.

Another class of preferred solvents for use as penetrants is glycol ethers, which are water soluble. Examples of glycol ethers include dipropylene glycol methyl ether (available under the trade designation DOWANOL DPM from Dow Chemical Co.), diethylene glycol methyl ether (available under the trade designation DOWANOL DM from Dow Chemical Co.), propylene glycol methyl ether (available under the trade designation DOWANOL PM from Dow Chemical Co.), and ethylene glycol monobutyl ether (available under the trade designation DOWANOL EB from Dow Chemical Co.).

Surfactants also are a suitable penetrant for use in the pre-treatment solution. Examples of suitable surfactants include nonionic, cationic, and anionic surfactants. Nonionic surfactants are preferred. Nonionic surfactants improve soil removal and can reduce the contact angle of the solution on the surface being treated. Examples of suitable nonionic surfactants include alkyl-, aryl-, and arylalkyl-, alkoxylates, alkylpolyglycosides and their derivatives, amines and their derivatives, and amides and their derivatives. Additional useful nonionic surfactants include those having a polyalkylene oxide polymer as a portion of the surfactant molecule. Such nonionic surfactants include, for example, chlorine-, benzyl-, methyl-, ethyl-, propyl-, butyl- and other like alkyl-capped polyoxyethylene and/or polyoxypropylene glycol ethers of fatty alcohols; polyalkylene oxide free nonionics such as alkyl polyglycosides; sorbitan and sucrose esters and their ethoxylates; alkoxylated ethylene diamine; carboxylic acid esters such as glycerol esters, polyoxyethylene esters, ethoxylated and glycol esters of fatty acids, and the like; carboxylic amides such as diethanolamine condensates, monoalkanolamine condensates, polyoxyethylene fatty acid amides, and the like; and ethoxylated amines and ether amines and other like nonionic compounds. Silicone surfactants can also be used.

Additional suitable nonionic surfactants having a polyalkylene oxide polymer portion include nonionic surfactants of $C_6$-$C_{24}$ alcohol ethoxylates having 1 to about 20 ethylene oxide groups; $C_6$-$C_{24}$ alkylphenol ethoxylates having 1 to about 100 ethylene oxide groups; $C_6$-$C_{24}$ alkylpolyglycosides having 1 to about 20 glycoside groups; $C_6$-$C_{24}$ fatty acid ester ethoxylates, propoxylates or glycerides; and $C_4$-$C_{24}$ mono or dialkanolamides.

If a surfactant is used as a penetrant, the amount of surfactant in the pre-treatment and/or override solution is typically about 100 ppm. Acceptable levels of surfactant include about 0.01% to about 0.5%.

Builders

The pre-treatment solution and/or override use solution can also include a builder. Builders include chelating agents (chelators), sequestering agents (sequestrants), detergent builders, and the like. The builder often stabilizes the composition or solution. Examples of builders include phosphonic acids and phosphonates, phosphates, aminocarboxylates and their derivatives, pyrophosphates, polyphosphates, ethylenediamene and ethylenetriamene derivatives, hydroxyacids, and mono-, di-, and tri-carboxylates and their corresponding acids. Other builders include aluminosilicates, nitroloacetates and their derivatives, and mixtures thereof. Still other builders include aminocarboxylates, including salts of ethylenediaminetetraacetic acid (EDTA), hydroxyethylenediaminetetraacetic acid (HEDTA), and diethylenetriaminepentaacetic acid. Preferred builders are water soluble.

Particularly preferred builders include EDTA (including tetra sodium EDTA), TKPP (tripotassium polyphosphate), PAA (polyacrylic acid) and its salts, phosphonobutane carboxylic acid, and sodium gluconate.

The amount of builder in the pre-treatment solution, if present, is typically between about 0.1 wt-% to about 5 wt-%. Acceptable levels of builder include 0.25 to 1.0 wt-% and 1 wt-% to 2.5 wt-%.

Methods of Cleaning

In some aspects, the present invention provides methods for removing soil from a surface comprising: applying a pre-treatment use solution to the surface; and applying an override use solution to the surface. A rinse step may or may not be present between the application of the pre-treatment use solution and the override use solution. A gas generating use solution is present in either the pre-treatment use solution or the override use solution.

In some embodiments, the pre-treatment and override steps are followed by only a rinse step. In other embodiments, the pre-treatment and override steps are followed by a conventional CIP method suitable for the surface to be cleaned. In still yet other embodiments, the pre-treatment and override steps are followed by a CIP method such as those described in U.S. patent application Ser. Nos. 10/928,774 and 11/257,874 entitled "Methods for Cleaning Industrial Equipment with Pre-treatment," both of which are hereby incorporated by reference in their entirety.

The combination of pre-treatment and override use solution selected is also dependent on the rate of override desired. As used herein the term "rate of override," refers to the mole equivalents of gas evolved per liter of solution applied to the surface to be cleaned over time. That is, the rate of override for a particular cleaning cycle is the number of moles of gas produced by a given amount of override use solution reacting with the pre-treatment use solution per liter of solution over time. The combination of pre-treatment and override use solutions are selected such that the rate of override is enough to cause an effective amount of soil disruption and cleaning, without any substantial adverse effects occurring to the surface or equipment being cleaned.

For example, in some embodiments, a pre-treatment use solution comprising a carbon dioxide gas generating use solution, e.g., a solution comprising a carbonate or bicarbonate salt, is applied to the surface to be cleaned. An override use solution comprising an acid is then applied to the surface. The rate of override for the cleaning cycle is the number of moles of carbon dioxide produced by acid reacting with the excess carbonate or bicarbonate salt, over time, i.e., the length of the cleaning cycle.

In some embodiments, a pre-treatment use solution comprising a gas generating use solution comprising about 0.2% to about 3.0% of a carbon dioxide producing salt is applied to the surface to be cleaned. An override use solution comprising about 2.0% acid is applied to the surface thereafter, i.e., with no rinse step in between, for about 4 to about 20 minutes. The rate of override is about ($1.0\times10^{-3}$ $M_{CO2}$) $min^{-1}$ to about ($1.0\times10^{-1}$ $M_{CO2}$) $min^{-1}$. Expressed in terms of liters of gas generated per liters of solution, the rate of override is about ($2.24\times10^{-3}$ liters $CO_2$/liter solution) $min^{-1}$ to about ($2.24\times10^{-1}$ liters $CO_2$/liter solution) $min^{-1}$.

Time

In some aspects of the invention, the pre-treatment use solution is applied to the surface for a sufficient amount of time such that the pre-treatment use solution penetrates into the soil to be removed. Pre-treatment use solution penetration into the soil allows for gas generation to occur in the soil upon activation of the pre-treatment by the override solution. In some embodiments, the pre-treatment use solution is applied to the surface to be cleaned for about 1 to about 30 minutes. In some embodiments, the pretreatment use solution is applied to the surface to be cleaned for about 5 to about 15 minutes. In some embodiments, the pre-treatment use solution is applied to the surface for about 10 minutes. It is to be understood that any value between these ranges is to be encompassed by the methods of the present invention.

In some aspects of the present invention the override use solution is applied to the surface for an amount of time sufficient to effectively clean the selected surface, and activate the pretreatment chemistry, i.e., generate gas. In some embodiments, the override use solution is applied for about 1 to about 30 minutes. In some embodiments, the override use solution is applied for about 5, about 10, or about 15 minutes. It is to be understood that all values and ranges between these values and rages are encompassed by the methods of the present invention.

Temperature

The methods of the present invention provide for effective soil removal without the necessity of high temperatures, i.e., above 60° C. That is the methods of the present invention provide effective soil removal without the need to pre-heat the pre-treatment and/or override use solutions. Further, the methods of the present invention do not require the surface to be cleaned to be preheated.

Specifically, it has been found that the methods of the present invention are more effective at lower temperatures than at higher temperatures, contrary to conventional CIP methods of cleaning. Without wishing to be bound by any particular theory, it is thought that the decreased soil removal at high temperatures is due to an increased reaction rate, i.e., the reaction between the pre-treatment and override use solutions. This increased reaction results in a lowered ability to generate gas on and in the soil.

In some aspects, both the application of the pre-treatment use solution and the override use solution occur at a temperature of about 2° C. to about 50° C. In some embodiments, the methods of the present invention provide effective soil removal at ambient or room temperature, i.e., about 18° C. to about 23° C. All values and ranges between these values and ranges are to be encompassed by the methods of the present invention.

The ability to clean at reduced temperatures results in energy and cost savings compared to traditional cleaning techniques that require increased temperatures. Further, the present invention provides for effective soil removal on surfaces that cannot withstand high temperatures.

It has also been found that when performed at lower temperatures, e.g., about 40° C., the methods of the present invention can provide effective soil removal with a lower concentration of gas generating use solutions than at higher temperatures. For example, it has been found that at about 40° C., a 1% gas generating use solution results in about 70% soil removal. At 80° C., a 1% gas generating use solution results in about 30% soil removal. Thus, the methods of the present invention can effectively remove soil at both low temperatures, and low concentration of use solutions, thereby providing both an energy savings and a reduction in the amount of chemistry consumed per cleaning.

Uses

Although previously described for use as a CIP cleaning method, the methods of the present invention can be used to remove soil in other applications as well. For example, the methods of the present invention can be used to clean hard surfaces, e.g., walls, floors, dishes, flatware, pots and pans, heat exchange coils, ovens, fryers, smoke houses, sewer drain lines, and vehicles. The methods of the present invention can also be used to clean textiles, e.g., fabric, and carpets. In some embodiments, the methods of the present invention are used to clean laundry. For example, a pre-treatment use solution is applied to the laundry for an amount of time sufficient to allow the pre-treatment use solution to soak into the soil. An override use solution is applied to the laundry resulting in gas generation and a soil disruption effect. This process could be followed by a conventional machine wash cycle to remove the loosened soil. Alternatively, this process could be followed with only a rinse step to remove any loosened soil and remaining override use solution. Other laundry applications include, but are not limited to, use as a machine detergent, and laundry pre-spotter.

The methods of the present invention can also be used as a method for treating carcasses and food products. For example, a pre-treatment use solution comprising a gas generating use solution can be applied to the surface of a carcass or food product, e.g., vegetable. The gas generating use solution can comprise a carbon dioxide generating salt, e.g., a carbonate or bicarbonate salt, and a chlorine dioxide gas generating composition, e.g., $NaClO_2$. After a sufficient pre-treatment time, an override use solution comprising an acid is applied to the surface. This combination would result in the generation of acidified sodium chlorite (ASC), and chlorine dioxide on the surface, as well as carbon dioxide gas. Without wishing to be bound by any particular theory, it is believed that the generation of carbon dioxide in addition to the ASC and chlorine dioxide would result in enhanced cleaning due to the increased surface activity, i.e., soil disruption, caused by the gas bubbles in the soil. It is thought that such a method would result in increased cleaning efficacy while consuming less chemistry.

For a more complete understanding of the invention, the following examples are given to illustrate some embodiments. These examples and experiments are to be understood as illustrative only and not limiting.

EXAMPLES

The following materials, methods and examples are meant to be illustrative only and are not intended to be limiting.

Example 1—Removal of Thermally Degraded, High Density Organic Soils

A thermally degraded, high density organic soil was prepared for use in the following examples. To prepare the soil, twenty grams of ketchup was spread onto one side of a stainless steel screen, and pushed through to make a thick coating on the back of the screen as well. The coated screens were dried at 60° C. for 20 minutes until the soil was tacky to the touch. FIG. 1 is a photograph of two soiled screens prior to any cleaning treatment.

a) Pre-Treatment Use Solution Containing a Single Gas Generating Solution

The following solutions were prepared in separate beakers at 160° F.: 1) 1% Sodium Bicarbonate; and 2) 2% AC-55-5. AC-55-5 is a commercially available acidic composition consisting of 59.5% water, 3.5% phosphoric acid, 37.0% and nitric acid. A stir bar was placed in each beaker and the solutions were stirred at 450 rpm.

Figure 2:
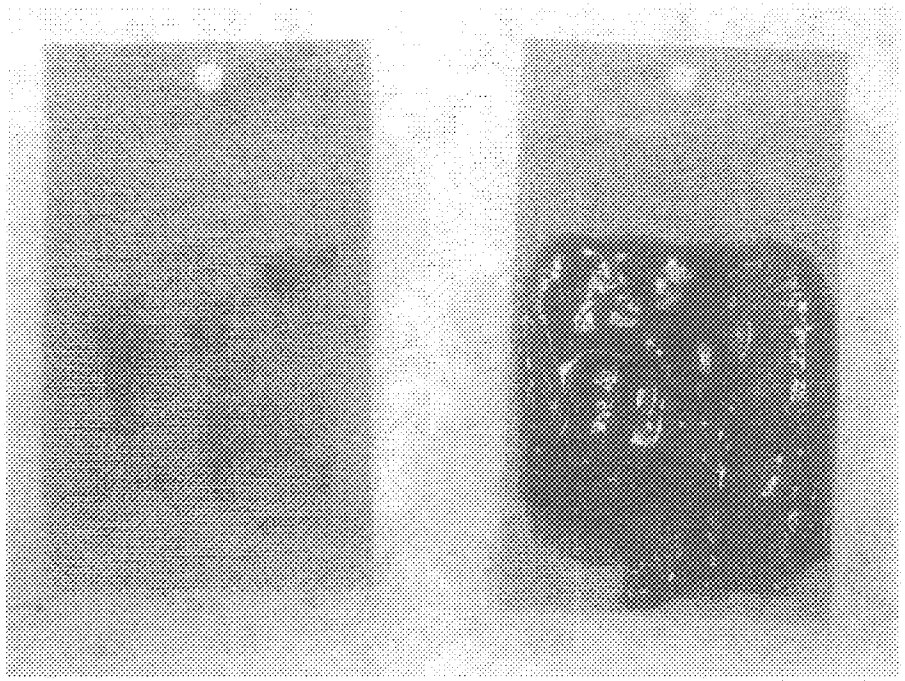
FIG. 2 is a photograph showing two soiled stainless steel screens after cleaning.

A screen soiled with a thermally degraded, high density organic soil as described above was placed into each beaker, and remained in the beakers for 10 minutes. After 10 minutes, AC-55-5 was added to the beaker containing the sodium bicarbonate solution. Enough AC-55-5 was added to make a 2% solution. The AC-55-5 was added in 5 equal additions over the course of 5 minutes. During this override step, vigorous bubbling was observed in the solution as well as on and in the soil. The vigorous bubbling caused pieces of the soil to become dislodged from the screen. A similar soil disruption effect was not observed in the AC-55-5 solution. FIG. 2 is a photograph showing the two ketchup soiled screens after these cleaning treatments. As can be seen in this Figure, the screen treated with sodium bicarbonate followed by the acid override showed considerable soil removal in comparison to the screen treated with the acid only.

b) Pre-Treatment Use Solution Containing More than One Gas Generating Solution

A test was run to measure the effectiveness of a mixture of gas generating use solutions in the pre-treatment use solution. Two screens were prepared of the thermally degraded high density organic soil as described above.

The following solutions were prepared in separate beakers at 160° F.: 1) 1% Sodium Bicarbonate, and 0.5% propylene carbonate; and 2) 2% AC-55-5. A stir bar was placed in each beaker and the solutions were stirred at 450 rpm. After 10 minutes, AC-55-5 was added to the beaker containing the sodium bicarbonate/propylene carbonate solution. Enough AC-55-5 was added to make a 2% solution. The AC-55-5 was added in 5 equal additions over the course of 5 minutes.

Figure 3:
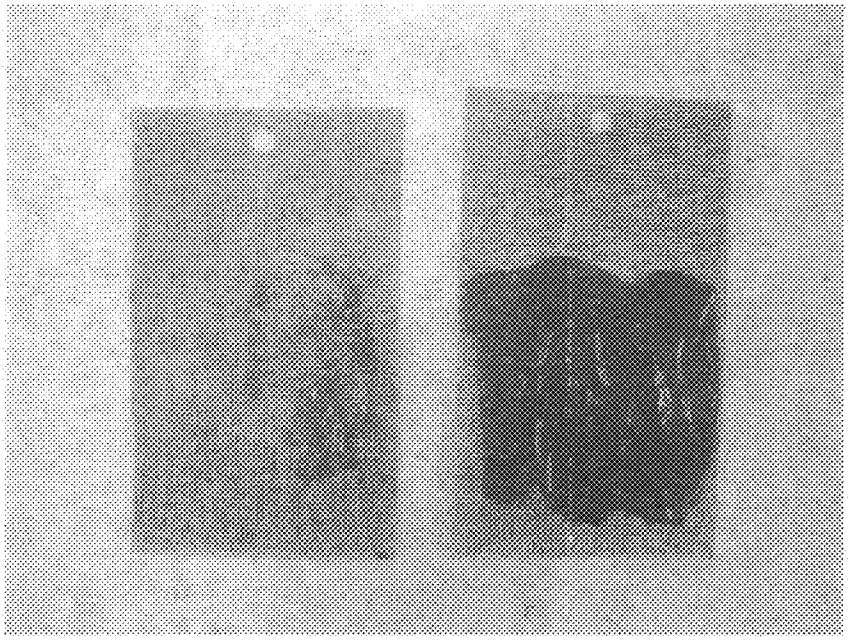
FIG. 3 is a photograph showing two soiled stainless steel screens after cleaning.

FIG. 3 is a photograph showing the screens after these cleaning treatments. As can be seen in this Figure, the screen treated with the combination of gas generating solutions, i.e., sodium bicarbonate/propylene carbonate, followed by the acid override showed considerable soil removal in comparison to the screen treated with the acid only.

c) Pre-treatment Use Solution Containing a Single Gas Generating Composition Compared to an Alkaline Treatment A test was run to compare the effectiveness of a pre-treatment use solution containing a single gas generating solution with an acidic override, to an alkaline cleaning treatment. Two screens were prepared with the thermally degraded high density organic soil as described above.

The following solutions were prepared in separate beakers at 160° F.: 1) 1% Sodium Bicarbonate; and 2) 1.5% NaOH. A stir bar was placed in each beaker and the solutions were stirred at 450 rpm. After 10 minutes, AC-55-5 was added to the beaker containing the sodium bicarbonate solution. Enough AC-55-5 was added to make a 2% solution. The AC-55-5 was added in 5 equal additions over the course of 5 minutes.

Figure 4:
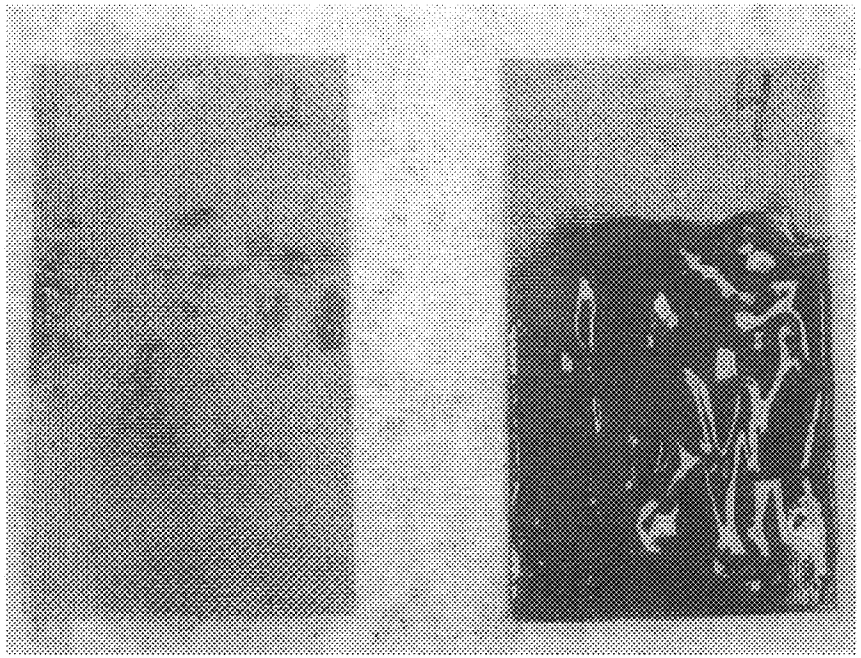
FIG. 4 is a photograph showing two soiled stainless steel screens after cleaning.

FIG. 4 is a photograph showing the screens after these cleaning treatments. As can be seen in this figure, the screen treated with the pre-treatment solution containing a gas generating solution, followed by the acid override showed almost total soil removal. The screen treated with only an alkaline wash showed little to no soil removal.

Example 2—Removal of Corn Ethanol Stillage a) Removal of Corn Ethanol Stillage at 80° F.

Figure 5:
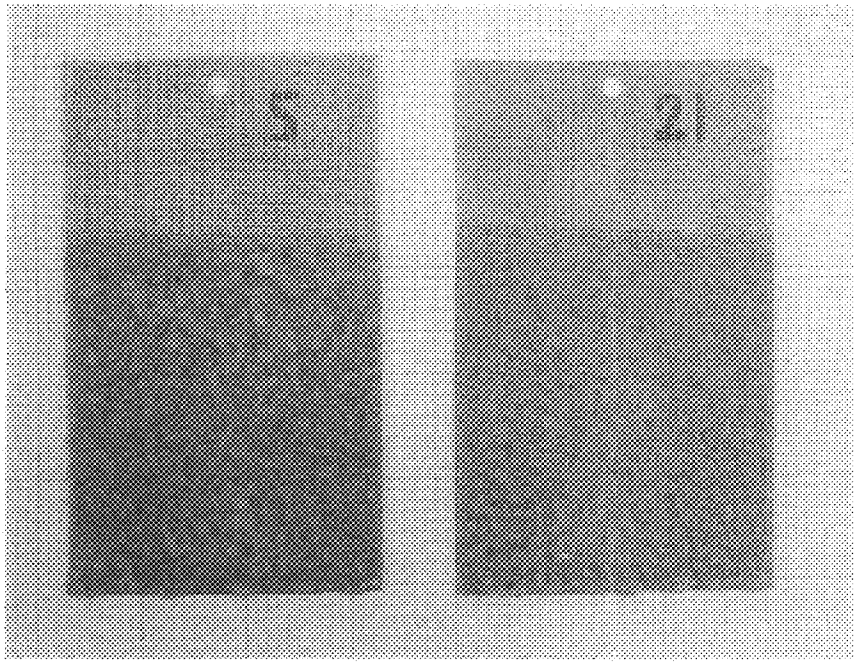
FIG. 5 is a photograph showing two stainless steel screens soiled with corn ethanol stillage prior to cleaning.

Dried-on corn ethanol stillage screens were prepared. Screens were prepared by dipping clean screens in ethanol stillage and drying at 80° C. for 1 hour. FIG. 5 is a photograph showing the soiled screens prior to cleaning. The following solutions were prepared in separate beakers at 80° F.: 1) 1% Sodium Bicarbonate; and 2) 2% AC-55-5. A stir bar was placed in each beaker and the solutions were stirred at 450 rpm. A screen with dried on corn ethanol stillage was placed in each beaker. After 10 minutes, AC-55-5 was added to the beaker containing the sodium bicarbonate solution. Enough AC-55-5 was added to make a 2% solution. The AC-55-5 was added in 5 equal additions over the course of 5 minutes. The screen remained in the solution for 10 minutes after the initial addition of the AC-55-5 to the bicarbonate solution. The screen in the AC-55-5 solution remained in the beaker for 20 minutes.

Figure 6:
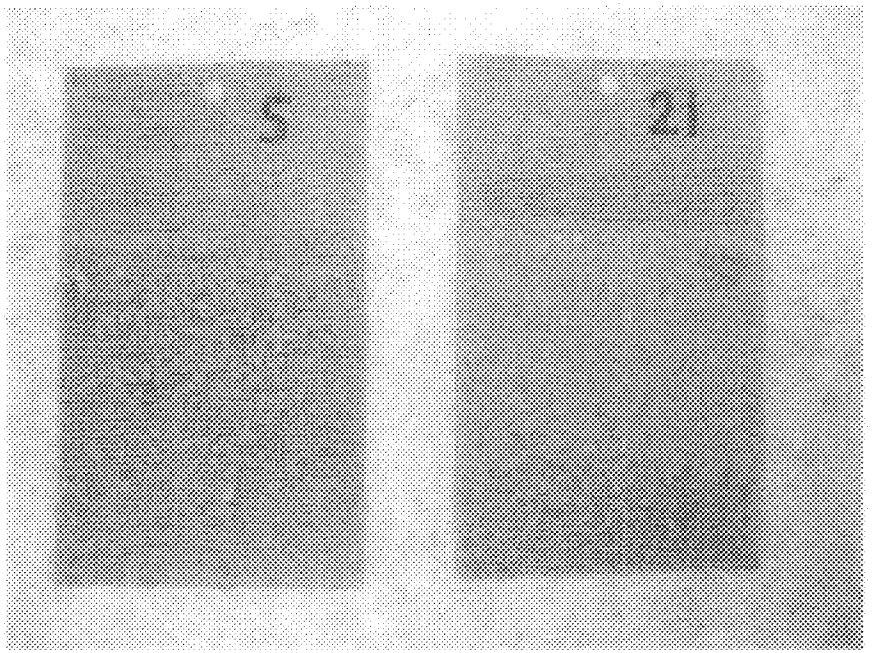
FIG. 6 is a photograph showing two corn ethanol stillage soiled stainless steel screens after 20 minutes of total clean time.
Figure 7:
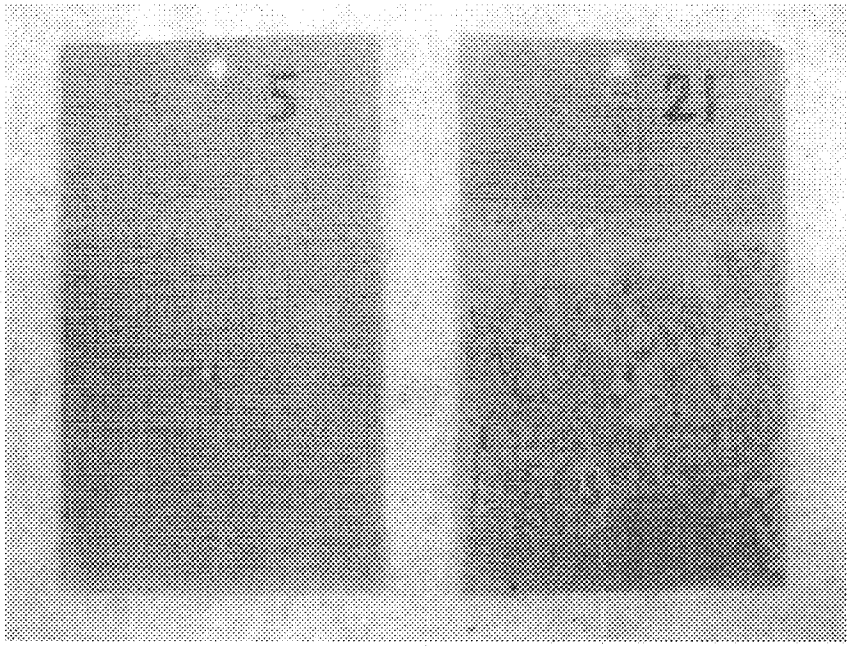
FIG. 7 is a photograph showing two corn ethanol stillage soiled stainless steel screens after 25 minutes of total clean time.

FIG. 6 is a photograph showing the two screens after the cleaning treatments. As can be seen in this figure, there was an increased soil removal observed with the use of the pre-treatment/override chemistry compared to the screen treated with acid alone. FIG. 7 is a photograph of two soiled screens after cleaning as described above for 25 minutes of total clean time (10 minutes pre-treatment, 15 minutes thereafter). As can be seen in this figure, the screen treated with the pre-treatment/override chemistry (the screen to the left) had a larger amount of soil removed compared to the screen treated with acid alone.

b) Removal of Corn Ethanol Stillage at 130° F.

A test was run to determine the effects of a pre-treatment/override cleaning process compared to an alkaline treatment at 130° F. Screens soiled with corn ethanol stillage were prepared as described above. Two formulas were prepared in separate beakers at 130° F.: 1) 1% Sodium Bicarbonate; and 2) 1% NaOH. A stir bar was placed in each beaker and the solutions were stirred at 450 rpm. A soiled screen was placed in each beaker. After 10 minutes, AC-55-5 was added to the beaker containing the sodium bicarbonate solution. Enough AC-55-5 was added to make a 2% solution. The AC-55-5 was added in 5 equal additions over the course of 5 minutes. The screen remained in the solution for 10 minutes after the initial addition of the AC-55-5 to the bicarbonate solution. The screen in the NaOH solution remained in the beaker for 20 minutes.

Figure 8:
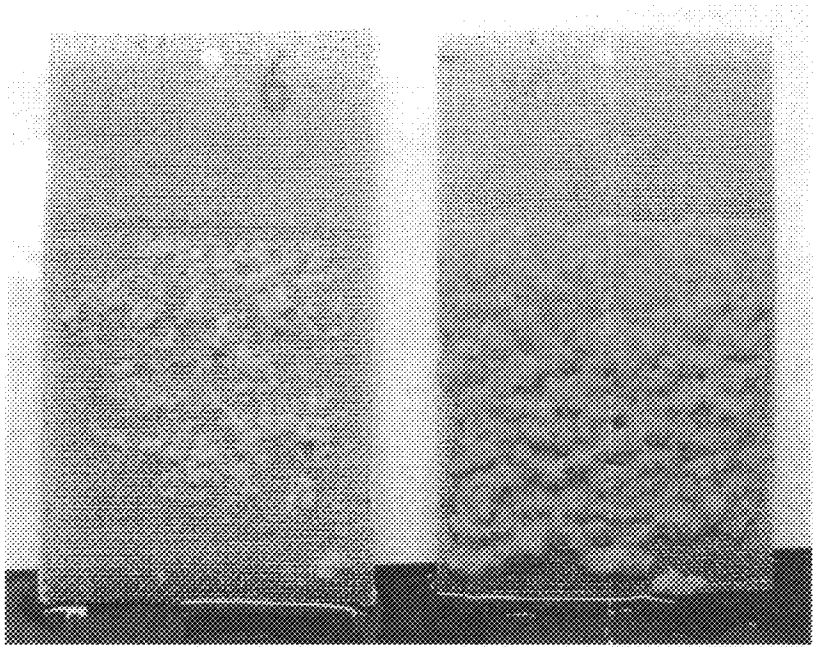
FIG. 8 is a photograph showing two corn ethanol stillage soiled stainless steel screens after cleaning.

FIG. 8 is a photograph showing the two screens after cleaning. As can be seen in this figure, the screen treated with the pre-treatment/override chemistry (the screen on the left) showed increased soil removal compared to the screen treated with NaOH alone.

Figure 9:
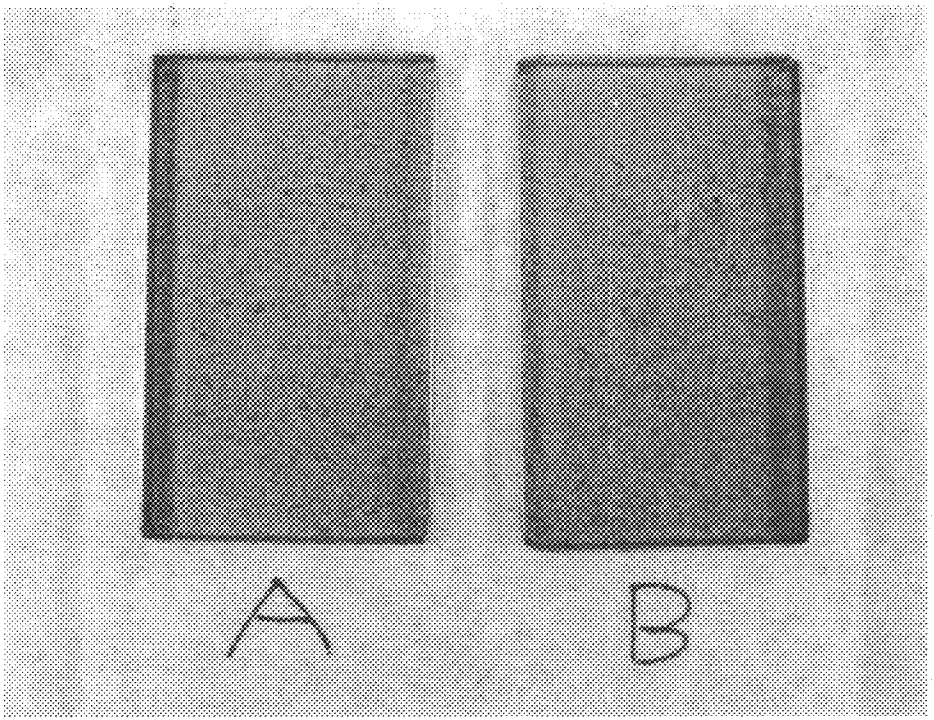
FIG. 9 is a photograph showing two stainless steel trays soiled with brewery trub prior to cleaning.
Figure 10A:
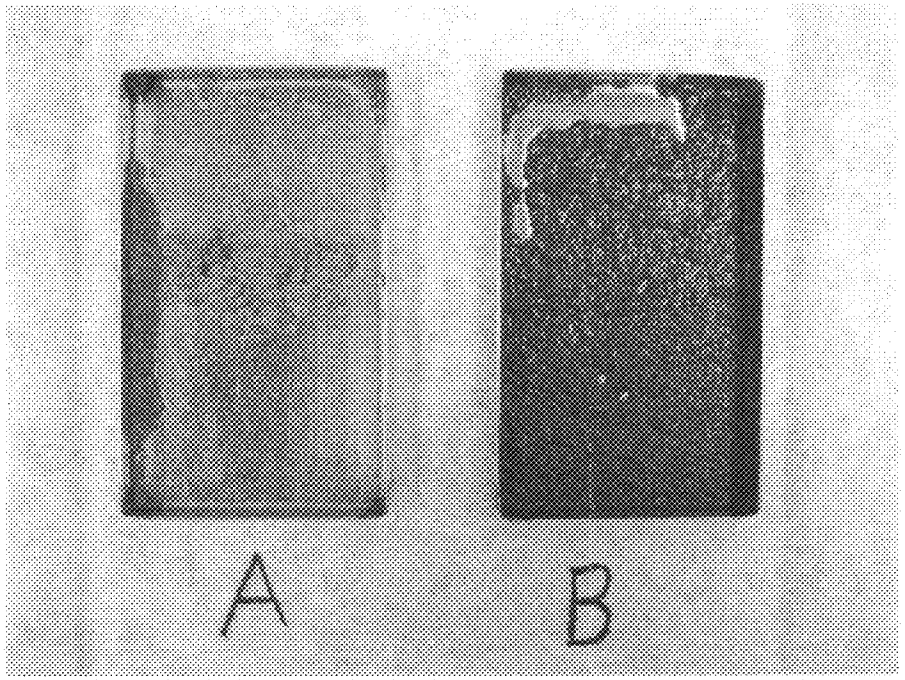
FIG. 10A is a photograph showing two brewery trub soiled stainless steel trays after cleaning at 60° F.

Example 3—Removal of Brewery Trub a) Removal of Brewery Trub Soil from a Stainless Steel Surface Thirty milliliters of brewery trub was cooked down on a hot plate in stainless steel trays. FIG. 9 is a photograph showing the soiled stainless steel trays prior to cleaning. Tray A and tray B were placed in separate beakers with a stir bar stirring at a rate of 450 rpm. The tray labeled "A" was treated with the following cleaning chemistry: a pre-treatment solution consisting of sodium bicarbonate as the gas generating solution was applied to the tray for 15 min. An acidic override use solution was then applied to the tray. The override use solution consisted of 2% AC-55-5. The override use solution was applied for 15 minutes. Tray B was treated with 1.5% NaOH for 30 minutes. Both trays were treated with solutions at 60° F. As can be seen in FIG. 10A, Tray A showed improved cleaning over Tray B.

Figure 10B:
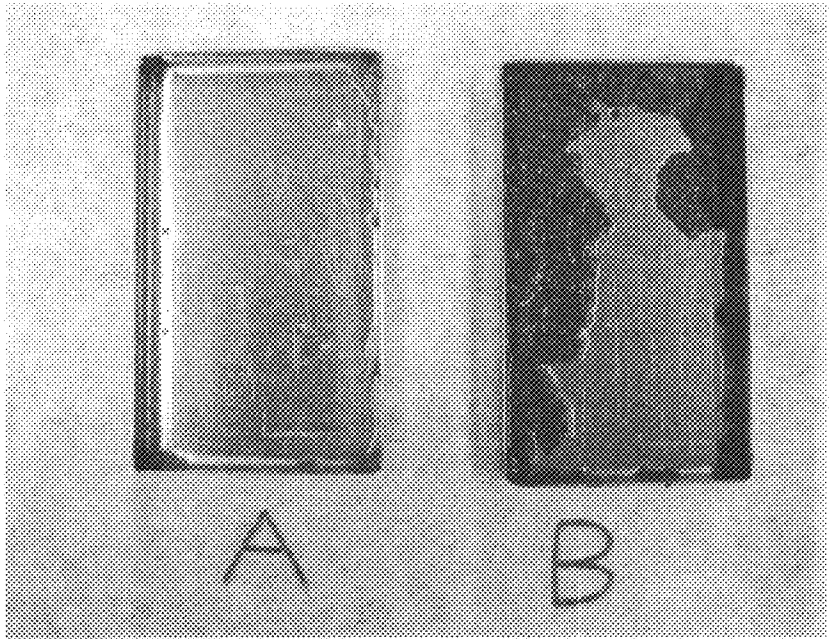
FIG. 10B is a photograph showing two brewery trub soiled stainless steel trays after cleaning at 70° F.

A second experiment was performed, applying the same cleaning chemistry described above at 70° F. instead of at 60° F., with stirring at a rate of 350 rpm. As can be seen in FIG. 10B, Tray A showed improved cleaning over Tray B under these conditions.

b) Removal of Brewery Trub Soil from a Screen

Figure 11B:
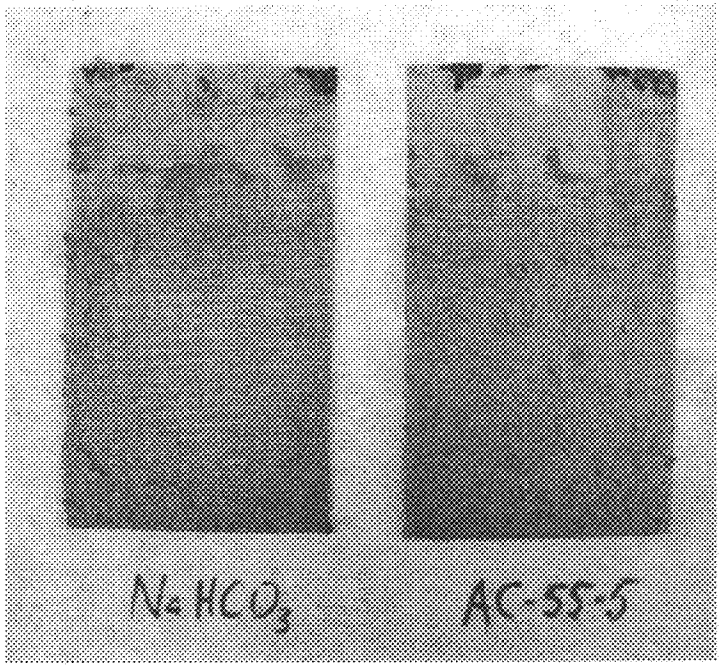
FIG. 11B is a photograph showing two brewery trub soiled stainless steel screens after cleaning.
Figure 11A:
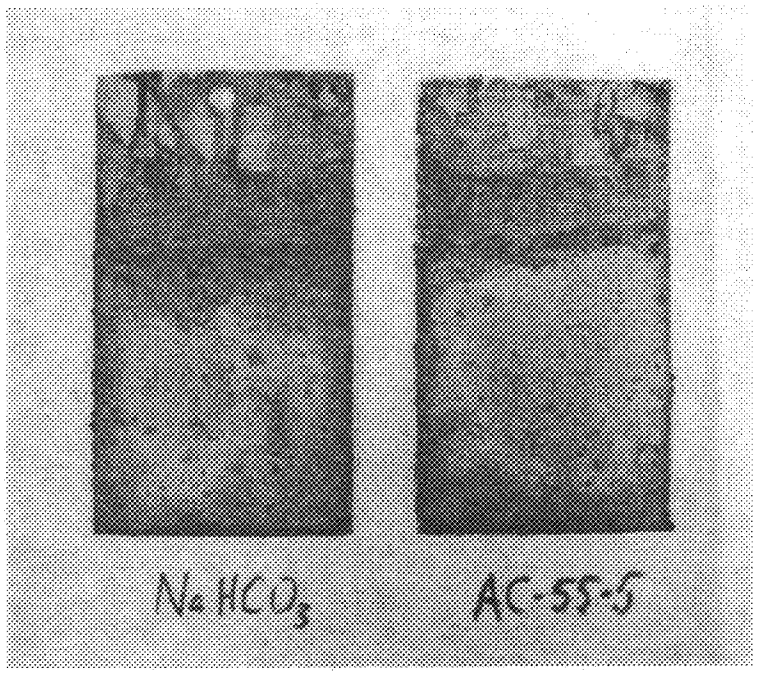
FIG. 11A is a photograph showing two stainless steel screens soiled with brewery trub prior to cleaning.

Twenty grams of brewery trub was evenly applied to a stainless steel screen and baked on at 300° F. until hard and slightly browned. FIG. 11A is a photograph of the screens prior to cleaning. One of the screens was placed into a beaker containing 1% sodium bicarbonate. The other screen was placed into a beaker containing 2% AC-55-5. Both solutions were at 60° F. with a stir bar stirring at 350 rpm. After 15 minutes of soaking, AC-55-5 was slowly added to the beaker containing sodium bicarbonate. A steady bubbling action in the soil and in solution occurred. Soil was observed loosening from the screen in the beaker containing sodium bicarbonate and acid, but not in the beaker with only the acid present. FIG. 11B is a photograph showing the screens after cleaning. As can be seen in this figure, the screen treated with the sodium bicarbonate pre-treatment showed improved cleaning. The lighter areas of each screen are the areas where soil removal occurred.

c) Removal of Brewery Soil—Brandhefe Ring—from a Beaker

Unfermented wort was obtained from a brewery and inoculated with top-fermenting yeast. 150 ml of wort was fermented in 250 ml Erlenmeyer flasks for one week. After this time, a ring of soil, i.e., a brandhefe ring, was present in the region previously occupied by the foam at the top of the fermenting beer. The beer was decanted along with most of the yeast cake on the bottom of the flasks. 170 ml of the following solutions was added to the flasks: flask 1) 1% sodium bicarbonate pretreatment solution for 5 min followed by an acid override solution consisting of AC-55-5; and flask 2) 2% AC-55-5 for the duration of the test. Both solutions were tested at 40° F. Stir bars were added to the flasks and the solutions were stirred at 200 rpm during the cleaning cycle.

The flask treated with the pre-treatment/override chemistry showed greatly improved cleaning compared to the flask treated with only acid.

Example 4—Additional Gas Generating Use Solutions

Other gas generating use solutions capable of generating carbon dioxide using the methods of the present invention were evaluated. 15 grams of ketchup was spread on one side of a screen and 5 grams was spread on the back side of the same screen. The screens were dried to a light tack. The following solutions were prepared in separate beakers: 1) 1.5% NaOH; 2) 1.0% $NaHCO_3$; 3) 1.0% $Na_2CO_3$; and 4) 1.0% $KHCO_3$. Each solution was prepared at 75° F. Stir bars were placed in each beaker and the solutions were stirred at 350 rpm for 15 minutes.

After 15 minutes, 20 grams of AC-55-5 was added to the beakers containing solutions 2, 3, and 4 over the course of ten minutes. Additional AC-55-5 was added to the sodium carbonate solution (#3) to bring the pH to about 2, as it was in the other solutions (solutions #2 and #4) after the override chemistry was added. During the override period, vigorous bubbling, i.e., gas generation, occurred in each of the beakers. No bubbling was observed in the solution containing NaOH (#1).

Figure 12:
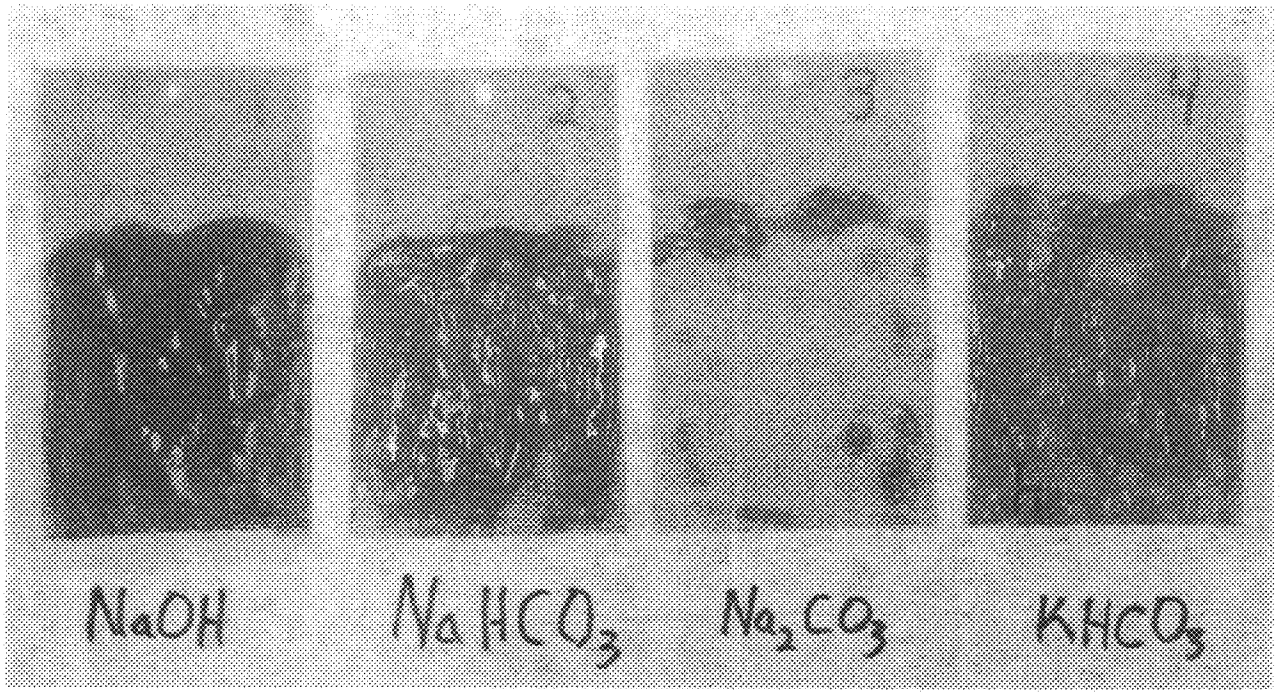
FIG. 12 is a photograph showing four soiled stainless steel screens after cleaning with four different cleaning solutions.

After 45 minutes of total clean time, including the 15 minutes of pre-treatment time, the screens that had pre-treatment/override chemistry assisted cleaning showed increased soil removal compared to the NaOH treated screen (FIG. 12). The lighter sections of each screen indicate where soil removal occurred. The screens were dried and weighed to assess soil removal efficacy. The results are provided in Table 1.

TABLE 1

| Treatment | NaOH | $NaHCO_3$ | $Na_2CO_3$ | $KHCO_3$ |
|---|---|---|---|---|
| Remaining Dry Soil Weight | 0.92 g | 0.39 g | 0.07 g | 0.33 g |

As can be seen from these results, the screen pre-treated with sodium carbonate weighed the least after cleaning. This indicates that the most effective soil removal occurred with this sample.

Example 5—Additional Gas Generating Use Solutions

Other gas generating use solutions capable of generating carbon dioxide using the methods of the present invention were evaluated. 15 grams of ketchup was spread on one side of a screen and 5 grams was spread on the back side of the same screen. The screens were dried to a light tack. The following solutions were prepared at 70° F. in four separate beakers: 1) 1% $MgCO_3$; 2) 1% $CaCO_3$; 3) 1% $NaHCO_3$; and 4) 1.5% NaOH. The beakers containing the $MgCO_3$ and $CaCO_3$ solutions had a milky appearance and a suspension of solids therein.

A soiled screen was placed into each beaker. A stir bar was placed in each beaker and the screens were allowed to soak for 10 minutes with 350 rpm stirring. After ten minutes, twenty grams of an override use solution, i.e., AC-55-5, was added to each of the beakers containing solutions 1-3. The AC-55-5 was added over the course of ten minutes. Additional AC-55-5 was added to the $MgCO_3$ and $CaCO_3$ solutions to bring the pH to about 2 as it was in the other override solutions, i.e., solution #3. During the override period, vigorous bubbling occurred in the beakers containing solutions 1-3. No bubbling was observed in the NaOH beaker.

Figure 13:
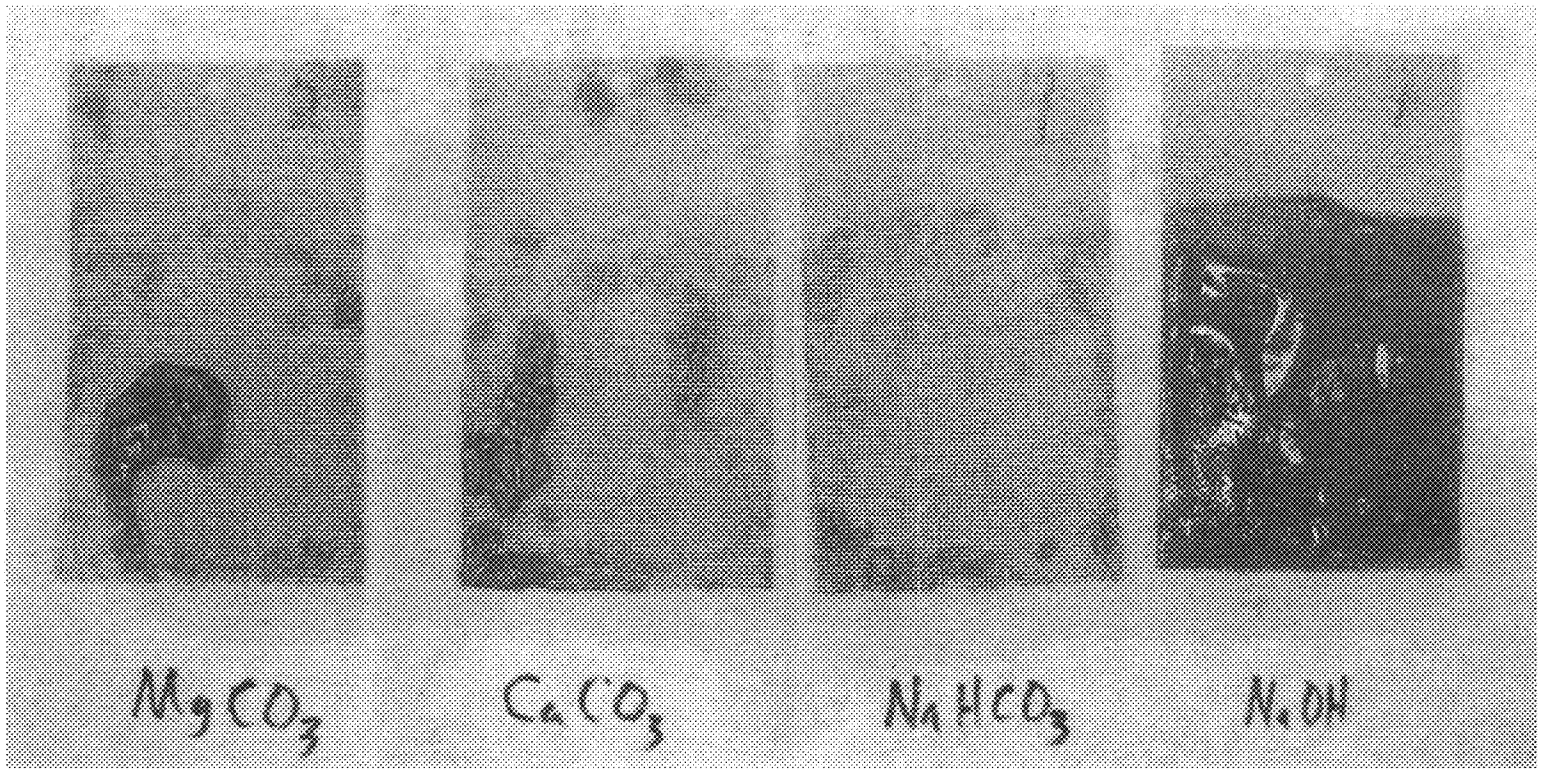
FIG. 13 is a photograph showing four soiled stainless steel screens after cleaning with four different cleaning solutions.

After 30 minutes of total clean time, including the 10 minutes of pre-treatment, the screens were removed from the solutions. FIG. 13 is a photograph showing the screens after cleaning. As can be seen in this figure, the screen treated with $NaHCO_3$ showed the best cleaning results. The screens treated with $MgCO_3$ and $CaCO_3$ also showed superior cleaning. The screen that did not receive an override with acid (the screen treated only with NaOH), showed very little soil removal.

Example 6—Order of Addition of Gas Generating Use Solution

In order to test the effectiveness of adding the gas generating use solution in the override use solution step as opposed to in the pre-treatment use solution, the following experiment was performed.

Brewery trub soil was used for this experiment. Two solid stainless steel trays that had been soiled with brewery trub soil were placed in separate beakers containing a pre-treatment use solution consisting of 2% AC-55-5 at 72° F. The pre-treatment solution was applied for 5 minutes. The solutions were stirred using a stir bar at a rate of 350 rpm. After the 5 minute pretreatment, an override use solution containing 10 grams of a gas generating use solution, i.e., $NaHCO_3$ was slowly added to one of the beakers. No override use solution was added to the second beaker. Vigorous bubbling was observed in solution after the addition of the override use solution, and was quickly followed by bits of removed soil accumulating on the top of the cleaning solution. This experiment showed that an override use solution containing a gas generating solution applied to a soiled surface after a pre-treatment use solution has been applied results in effective soil removal.

The same experiment was conducted using a gas generating use solution consisting of potassium carbonate ($K_2CO_3$). A stainless steel tray soiled with brewery trub was placed in a beaker containing a pre-treatment use solution consisting of 2% AC-55-5 at 72° F. The pre-treatment solution was applied for 5 minutes. The solution was stirred using a stir bar at a rate of 350 rpm. An override use solution comprising twelve grams of $K_2CO_3$ dissolved in 18 ml of deionized water was added over the course of 2 minutes. Vigorous bubbling was observed, again resulting in soil removal. The pH after the reaction was complete was about 7. Additional AC-55-5 was added (20 g). This resulted in another short cycle of bubble generation and the final pH was about 1.

Example 7—Determination of Rate of Override

Four screens soiled with a thermally degraded high density organic soil were prepared as described above in Example 1. Each screen was placed in a beaker containing one of the following solutions: 1) 1% NaHCO3 with 2%

AC-55-5 added in five doses; 2) 1% $NaHCO_3$ with 2% AC-55-5 added in a single dose; 3) 1.5% NaOH; and 4) 2% AC-55-5.

The experiment was conducted at 70° F. and at 160° F. At 70° F. the rate of reaction of the single dose addition was fairly mild and similar to the gradual addition override test. At 160° F., the reaction was violent after addition of the override use solution, i.e., AC-55-5, in a single dose. About 40% of the solution was ejected from the beaker. Differences in overall cleaning were inconclusive between solutions 1 and 2, but each of them far exceeded the cleaning results observed with solutions 3 and 4. Specifically, the screens treated with solutions 1 and 2 showed about 50% soil removal, and the screens treated with solutions 3 and 4 showed about 5% soil removal.

Example 8—Comparison with Conventional Products that Generate Gas

A variety of commercially available cleaning products are available that utilize a reaction between a carbonate or a bicarbonate salt and an acid to produce $CO_2$ gas. The conventional products use a one-step treatment in which the reaction happens in solution, not on and in the soil as it does with the methods of the present invention. The following experiments were run to compare the cleaning methods of the present invention with these conventional cleaning products.

Soiled screens, prepared as described above in Example 1, were placed in beakers containing the following solutions: 1) water and an air diffuser; 2) a denture cleaner table treatment used according to the packaged instructions; 3) 1% sodium bicarbonate with a stir bar and stirring at 100° F.; and 4) 1% sodium bicarbonate without stirring. After ten minutes of soaking, an override solution consisting of 2% AC-55-5 was added to solutions 3 and 4.

Figure 14:
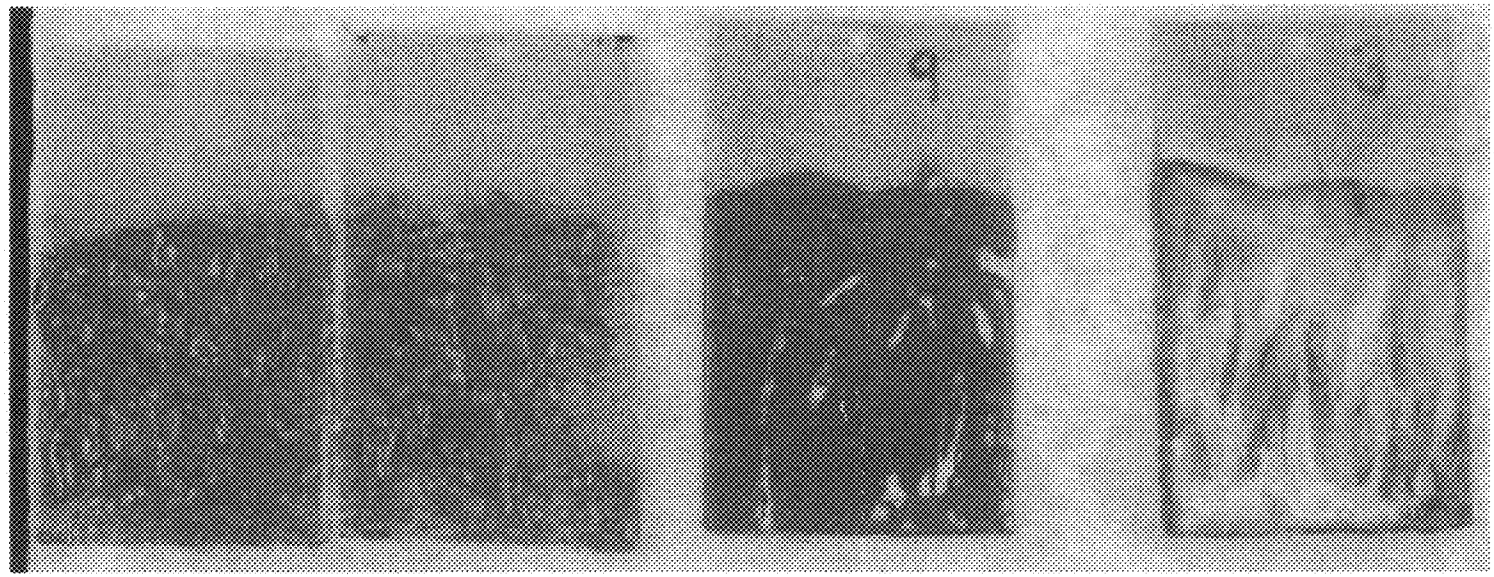
FIG. 14 is a photograph showing four soiled stainless steel screens after cleaning with the following four cleaning treatments: sodium bicarbonate pretreatment with 2% acid override with stirring; sodium bicarbonate pretreatment with 2% acid override with no stirring; air bubbles generated in solution by an air diffuser; and a denture cleaner.

FIG. 14 is a photograph showing the screens after these cleaning treatments. The samples were also weighed after cleaning. The results are shown in Table 2.

TABLE 2

| Treatment | Sample 1-Air Diffuser | Sample 2 - Denture Cleaner | Sample 3 - 1% sodium bicarbonate pretreatment with 2% Acid override, with stirring | Sample 4 - sodium bicarbonate pretreatment with 2% Acid override, without stirring |
|---|---|---|---|---|
| % Soil Removal | 13.0% | 5.0% | 31.4% | 32.0% |

As can be seen in FIG. 14, the screens treated with the methods of the present invention (samples 3 and 4) showed increased soil removal compared to those that were impacted by air bubbles delivered by a diffuser (sample 1). The sample treated with air bubbles from an air diffuser also weighed more than both samples 3 and 4, indicating that more soil remained on that screen compared to samples 3 and 4. Without wishing to be bound by any particular theory, it is thought that the enhanced soil removal seen with the methods of the present invention is due to the formation of $CO_2$ bubbles within the soil rather than bubbles formed on the outside of the soil. The lack of cleaning seen in the sample with surface impact by air bubbles (Sample 1) shows that surface bubbles are not the primary source of enhanced soil removal.

As can also be seen in FIG. 14, the screen treated with the denture cleaner (sample 2) did not show enhanced cleaning compared with those samples treated using the methods of the present invention (samples 3 and 4). Although foam did form on the surface of the soil of the sample treated with the denture cleaner, this foam did not result in soil removal.

The methods of the present invention were also compared to conventional bubbling action bathroom cleaners. Two stainless steel trays soiled with ethanol corn stillage were prepared as described above. One tray was place in a solution containing a sodium carbonate with sodium bisulfate foaming toilet bowl cleaner, which was used as directed on the package. The other tray was treated with a 1% Sodium Bicarbonate pre-treatment use solution at 25° C. After 10 minutes, this tray was treated with a 2% AC-55-5 override use solution for 20 minutes.

Figure 15:
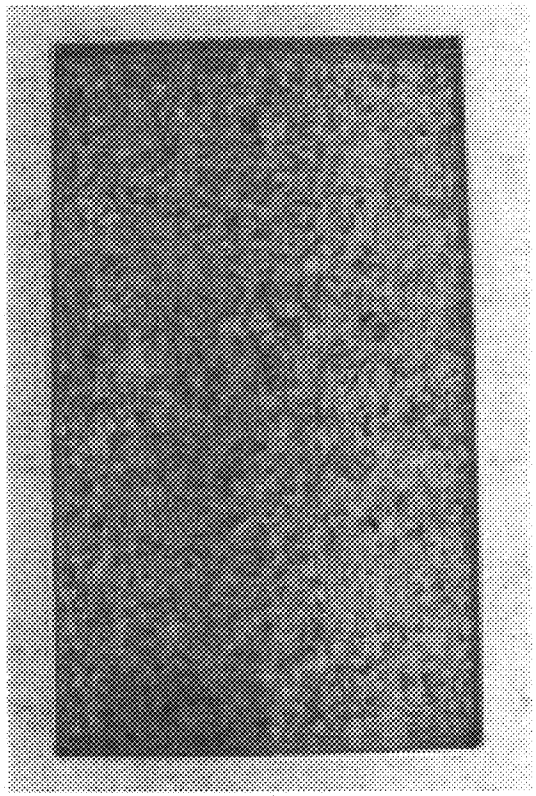
FIG. 15 is a photograph showing two ethanol corn stillage soiled stainless steel trays after cleaning.
Figure 15:
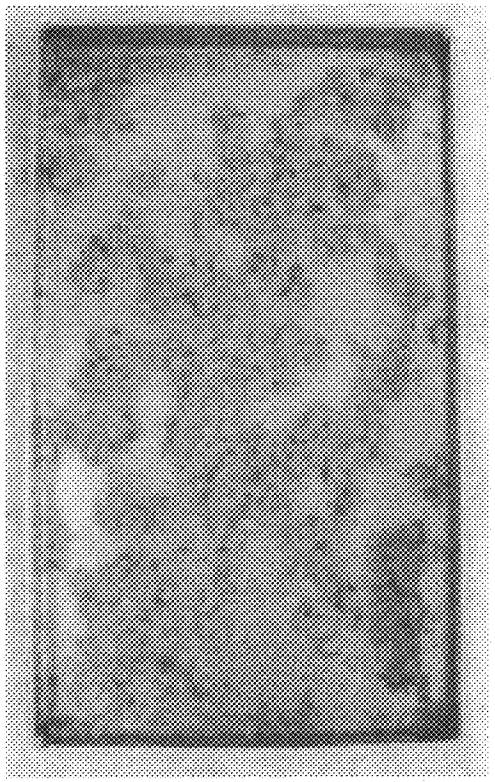

FIG. 15 is a photograph showing the trays after these cleaning treatments. The tray on the left was treated with the bubble action toilet bowl cleaner, and the tray on the right was treated with a gas generating pretreatment use solution and an acid override use solution. After cleaning, 14.56 g of soil remained on the tray treated with the toilet bowl cleaner, and 3.65 g of soil remained on the tray treated with the pretreatment and acid override use solution.

Although bubbling in solution was observed in the sample treated with the toilet bowl cleaner, this bubbling did not result in enhanced soil removal compared to the tray treated with the pre-treatment/override chemistry. Again, without wishing to be bound by any particular theory, it is thought that this difference in soil removal is due to the bubbles forming in the soil with the methods of the present invention, compared to only in solution using conventional cleaning chemistries.

Example 9—Time of Pre-Treatment

The following study was performed to determine the pre-treatment time that provides the maximum cleaning benefit. Four screens were equally soiled with corn stillage as described above in Example 2. Each screen was individually placed in a beaker containing a 1% sodium bicarbonate solution at 70° F. The acid override use solution was applied as follows: sample 1—the acid override use solution was added at 0 minutes; sample 2—the acid override was added after 5 minutes of pre-treatment; sample 3—the acid override was added after 10 minutes of pre-treatment; and sample 4—the acid override was added after 15 minutes of pre-treatment. The total clean time for each sample was 30 minutes.

Figure 16A:
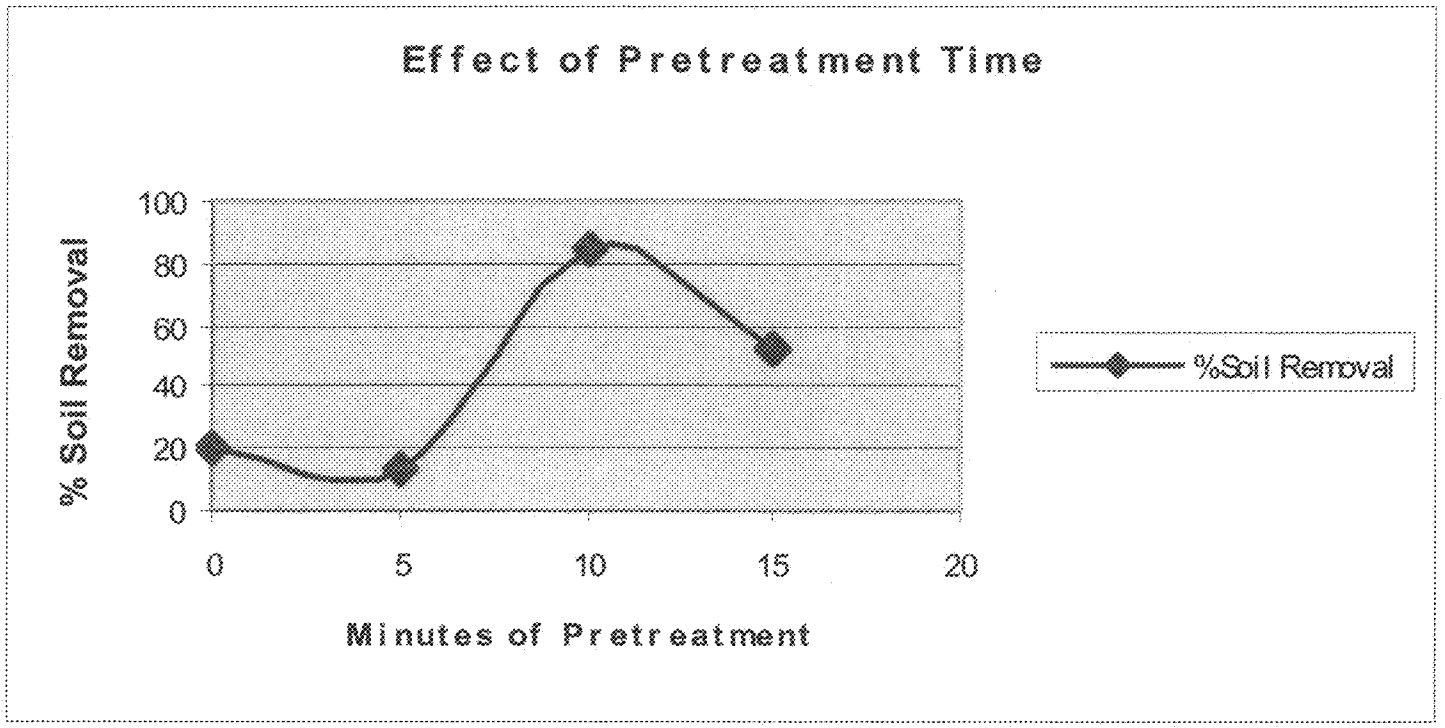
FIG. 16A is a graph illustrating the effect of pretreatment time on the percent soil removed.
Figure 16B:
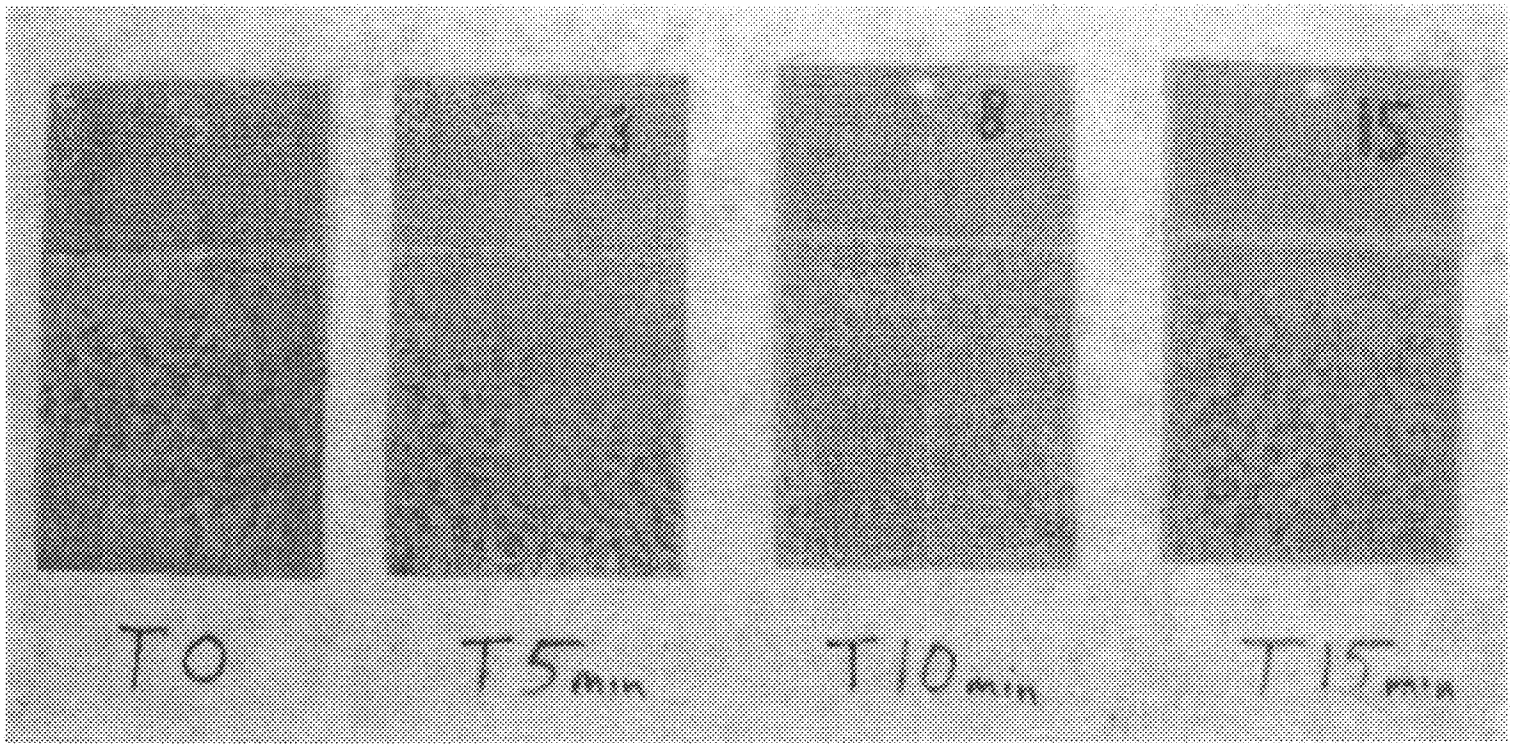
FIG. 16B is a photograph showing four corn ethanol stillage soiled screens after cleaning.

FIG. 16A is a graph depicting the effect of pre-treatment time on the amount of soil removed (% soil removal). FIG. 16B is a photograph showing the screens cleaned as described above with varying pre-treatment times. As can be seen in these figures, the maximum cleaning performance was realized with ten minutes of pre-treatment time.

Example 10—Removal of Soils in Brewery Fermentation Tanks

The following studies were performed to determine the effectiveness of the methods of the present invention in removing brewery soils.

a) Soil Removal from a Beer Tank

A horizontal bright beer tank was cleaned using the following method: first, a 1% potassium bicarbonate pre-treatment use solution was applied to the surface. After 15 minutes, an acidic override use solution comprising Trimeta OP was applied to the surface for an additional 15 minutes. Trimeta OP is a methanesulfonic based acid detergent with wetting and defoaming capabilities. During the application of the override use solution, bubbles were seen in the watch glass of the circuit.

Figure 17B:
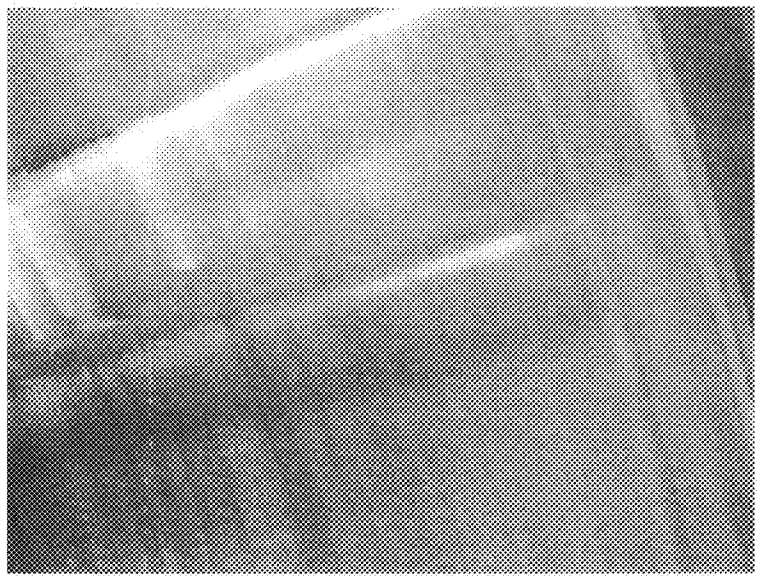
FIG. 17B is a photograph showing a horizontal bright beer tank after cleaning.
Figure 17A:
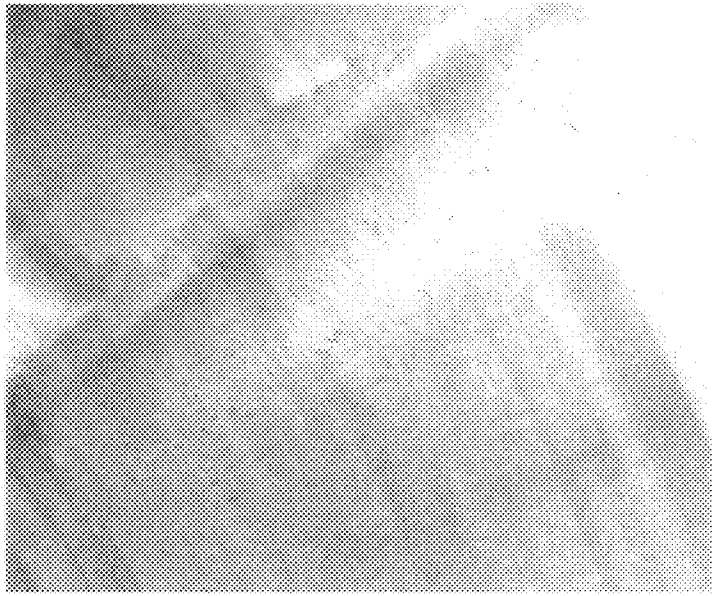
FIG. 17A is a photograph showing a horizontal bright beer tank prior to cleaning.

FIG. 17A is a photograph of the tank prior to cleaning. FIG. 17B is a photograph of the tank after being cleaned using the above described method. As can be seen in this figure, after cleaning, the amount of soil remaining on the surface of the tank was substantially removed.

b) Soil Removal from a Fermentation Tank

A fermentation tank with an extremely heavy soil produced by a Triple Bock beer with 40 days of fermentation and aging was selected. The soil sat for 5 days after the beer was drained prior to being cleaned. The following method was used: first, a 1% potassium bicarbonate pre-treatment use solution was applied to the surface for 10 minutes. After 10 minutes, an override use solution comprising Trimeta OP was applied to the tank. The temperature of the override use solution was about 50° F.

Figure 18B:
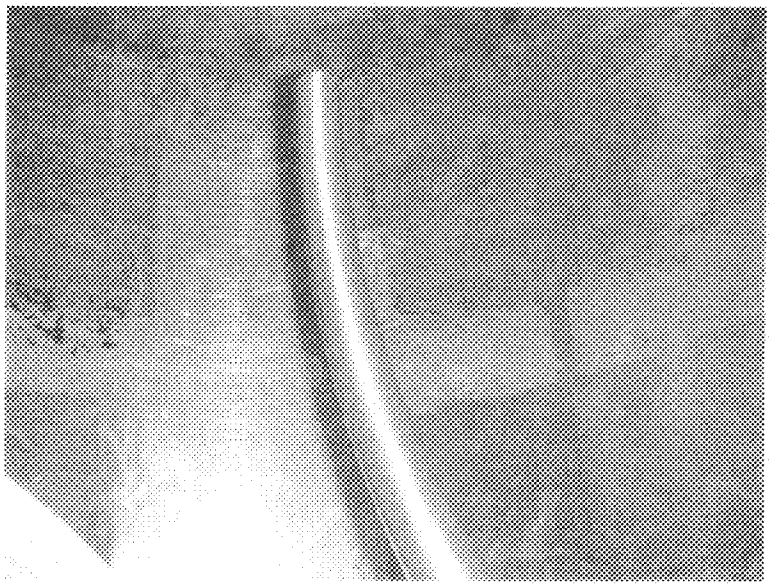
FIG. 18B is a photograph showing a soiled fermentation tank after cleaning.
Figure 18A:
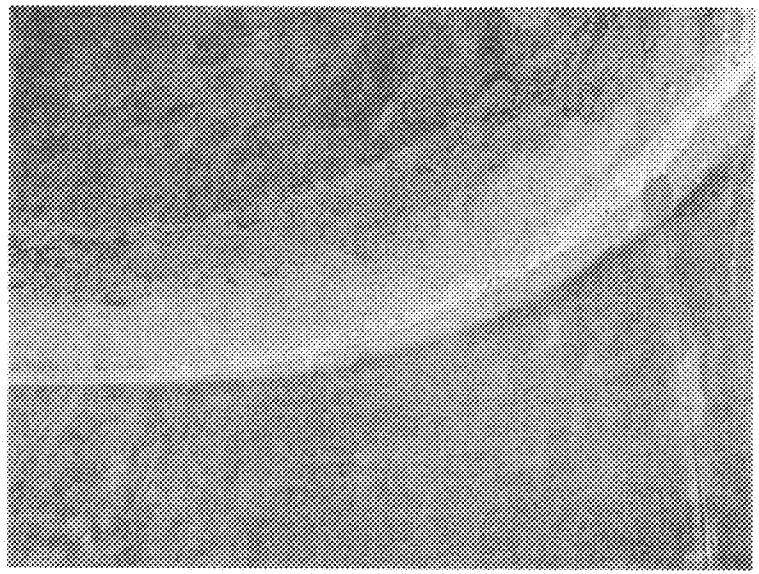
FIG. 18A is a photograph showing a soiled fermentation tank prior to cleaning.

FIG. 18A is a photograph of the soiled fermentation tank prior to cleaning. FIG. 18B is a photograph showing the tank after being cleaned as described above. As can be seen in this figure, although a majority of the soil was removed, there was not a complete removal of the soil. The remaining soil was thick and rubbery. It was noted that a number of variables were introduced into the cleaning cycle due to the standard cleaning methods used to clean fermentation tanks. Specifically during cleaning, the solution was routed to three different circuits at 10-15 minute intervals (spray ball, racking arm, and vent line). This did not result in the standard pre-treatment/override method described above.

Another test using sodium carbonate as the pretreatment yielded improved soil removal. Without wishing to be bound by any particular theory, it is thought that the increased pH and better wetting properties of the sodium carbonate solution increased the soil removal.

c) Removal of a Brandhefe Ring from a Brewery Tank

A tank with a heavy brandhefe ring present at the top of the tank was selected. The beer had been drained a week prior to cleaning. The following method was used: a pre-treatment use solution consisting of 1% sodium carbonate solution was applied to the surface. The pre-treatment solution was made using cold city water at about 45° F. After 15 minutes of pre-treatment, an override use solution consisting of 2% Trimeta OP was applied to the surface over about 10 minutes. A pH adjusting agent, 20% sulfuric acid, was added to get the final pH down to about 3.6 after 15 minutes of override use solution application. The tank was manually rinsed with water to drain.

Figure 19A:
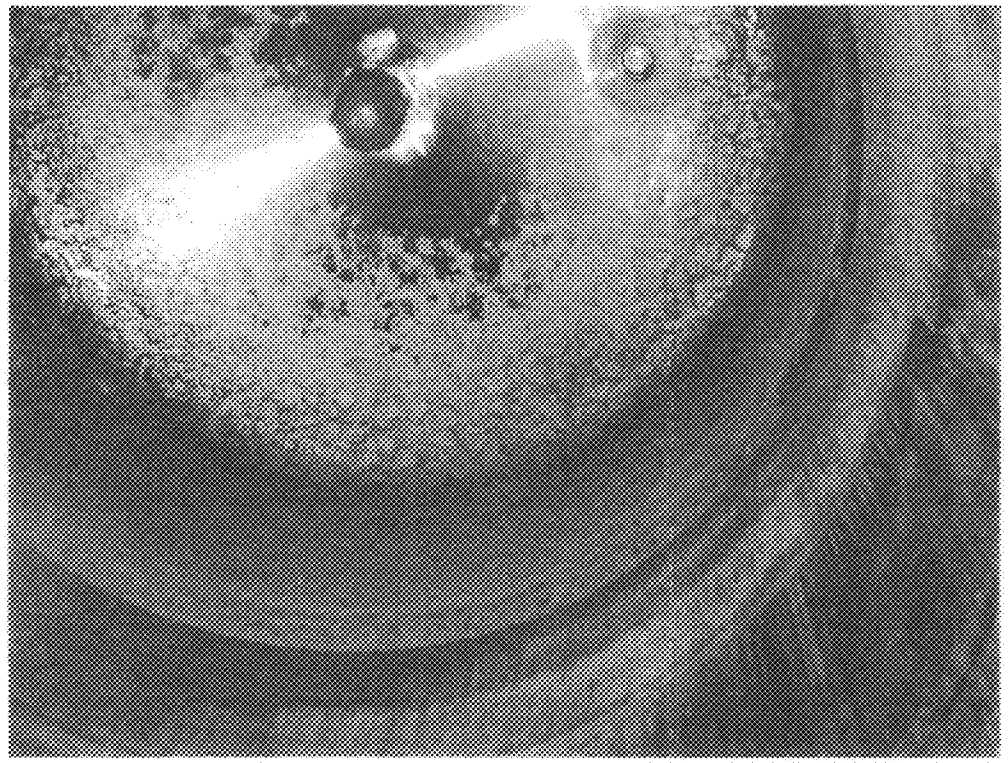
FIG. 19A is a photograph showing a heavy brandhefe ring at the top of a brewery tank.
Figure 19C:
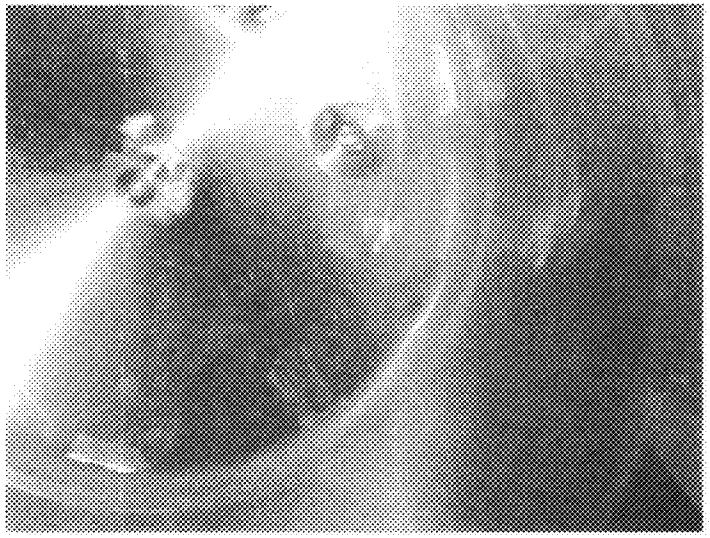
FIG. 19C is a photograph showing the brewery tank shown in FIG. 19A after cleaning.
Figure 19B:
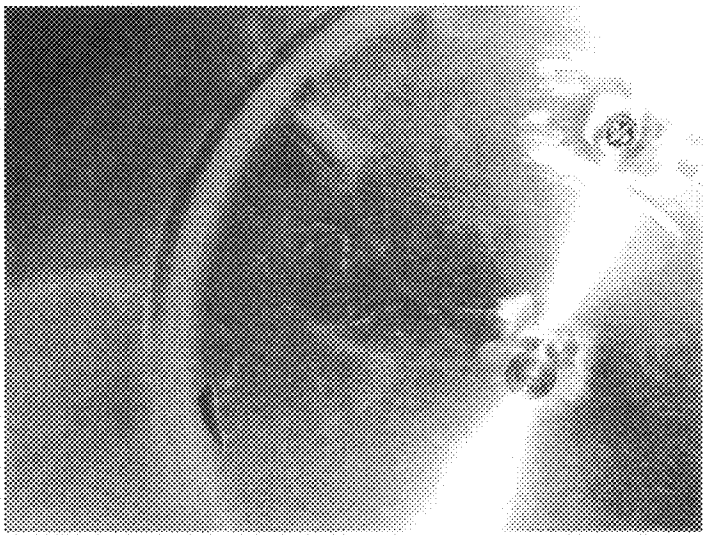
FIG. 19B is a photograph showing the brewery tank shown in FIG. 19A after cleaning.

FIG. 19A is a photograph showing the tank prior to cleaning. FIGS. 19B and 19C are photographs showing the tank after cleaning. As can be seen in these figures, most of the soil was removed except for a thin line on one side of the tank that was originally at the bottom of the brandehefe ring.

d) Soil Removal from a Brewery Tank

Figure 20B:
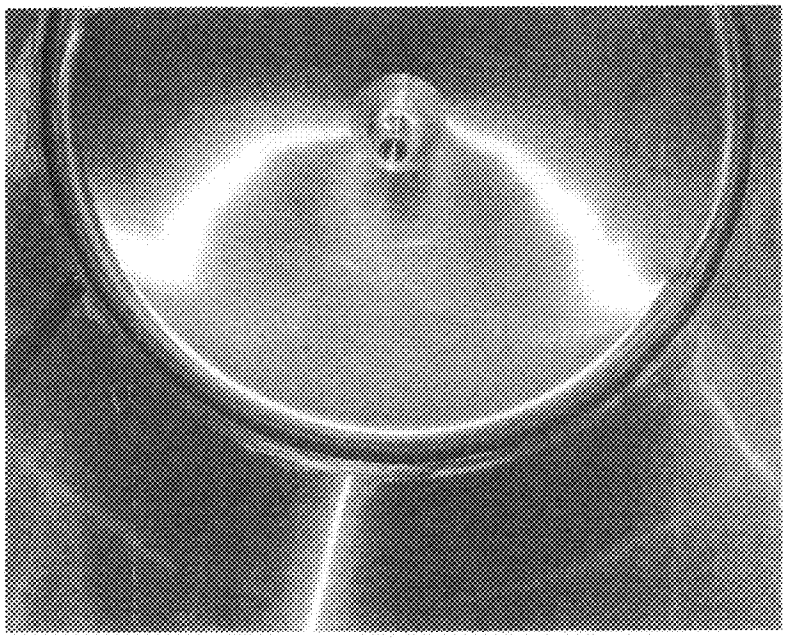
FIG. 20B is a photograph showing the brewery tank shown in FIG. 20A after cleaning.
Figure 20A:
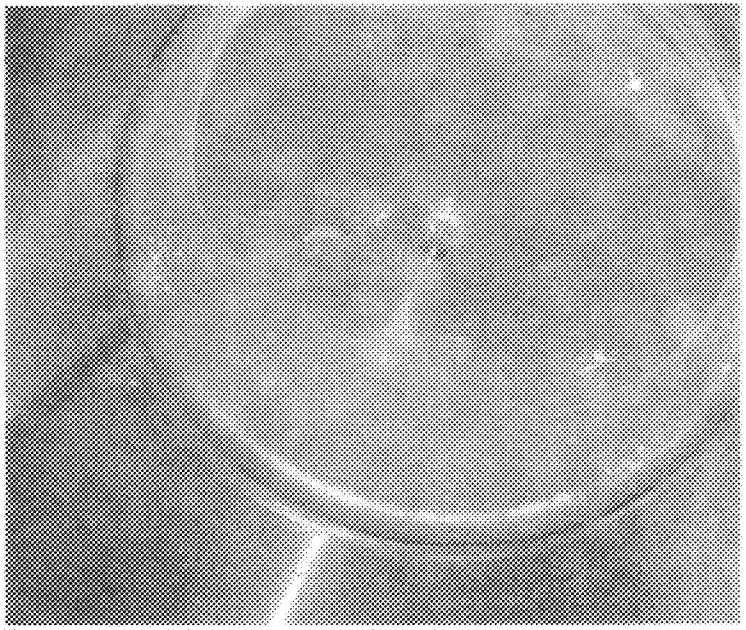
FIG. 20A is a photograph showing a soiled brewery tank prior to cleaning.

Another trial was run on a brewery tank. FIG. 20A is a photograph showing the tank prior to cleaning. A pre-treatment solution consisting of 1% sodium carbonate was applied to the tank for 15 minutes at 45° F. There was some foam generation during the pretreatment step. After 15 minutes, an override use solution consisting of 2% Trimeta OP and one gallon of 20% sulfuric acid was applied to the surface for ten minutes. This solution had a pH of about 7. The tank was rinsed with cold city water at 45° F. FIG. 20B is a photograph showing the tank after cleaning. As can be seen in this figure, this method resulted in substantial soil removal.

In order to compare the methods of the present invention to conventional tank cleaning techniques using Trimeta OP alone, two tanks were cleaned without a pre-treatment step. The first tank (shown in FIG. 21A prior to cleaning) was cleaned using 2% Trimeta OP alone, and the second tank (shown in FIG. 22A prior to cleaning) was cleaned using 2% Trimeta OP with 0.5% Stabicip Oxi added.

Figure 21B:
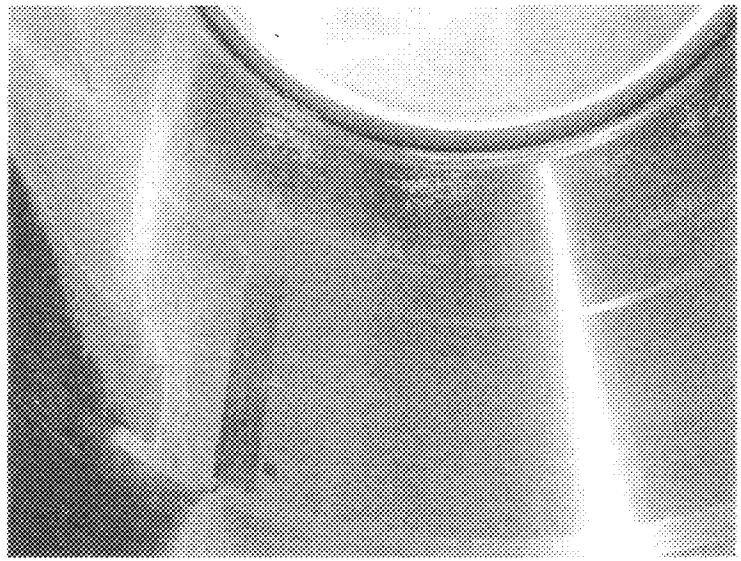
FIG. 21B is a photograph showing the brewery tank shown in FIG. 21A after being cleaned with Trimeta OP for 30 minutes.
Figure 21A:
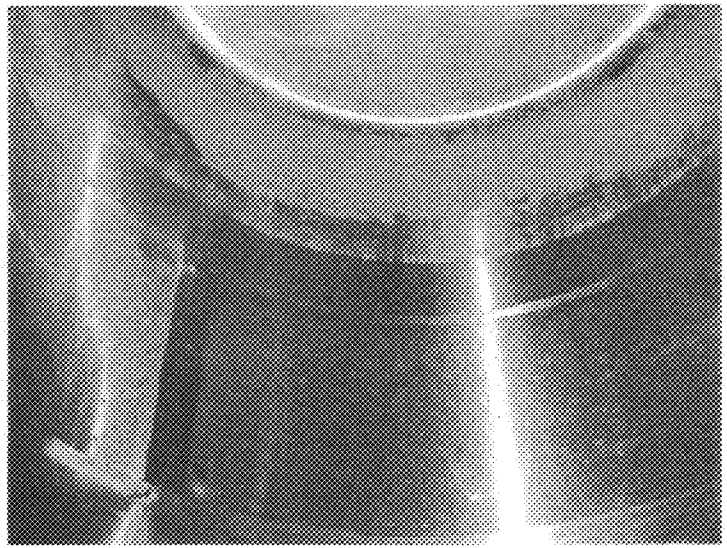
FIG. 21A is a photograph showing a soiled brewery tank prior to cleaning.
Figure 22B:
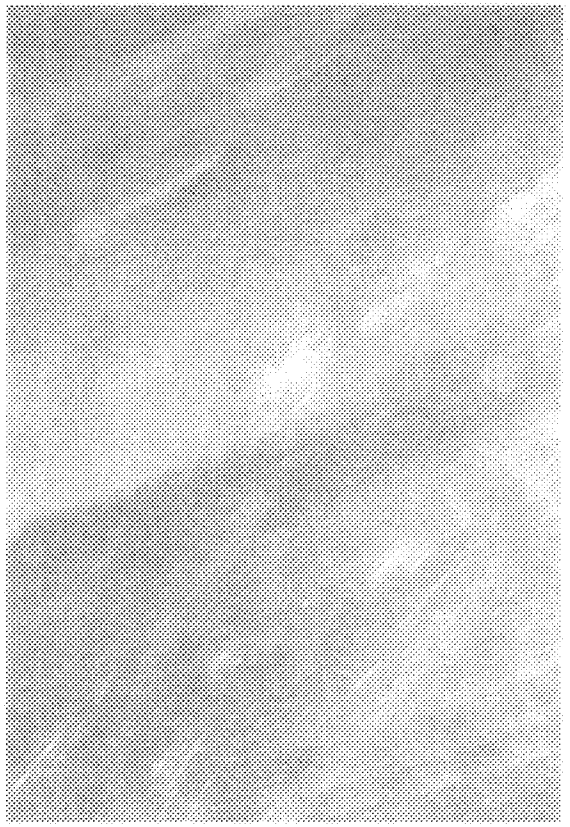
FIG. 22B is a photograph showing the brewery tank shown in FIG. 22A after being cleaned with Trimeta OP and Stabicip Oxi for 40 minutes.
Figure 22A:
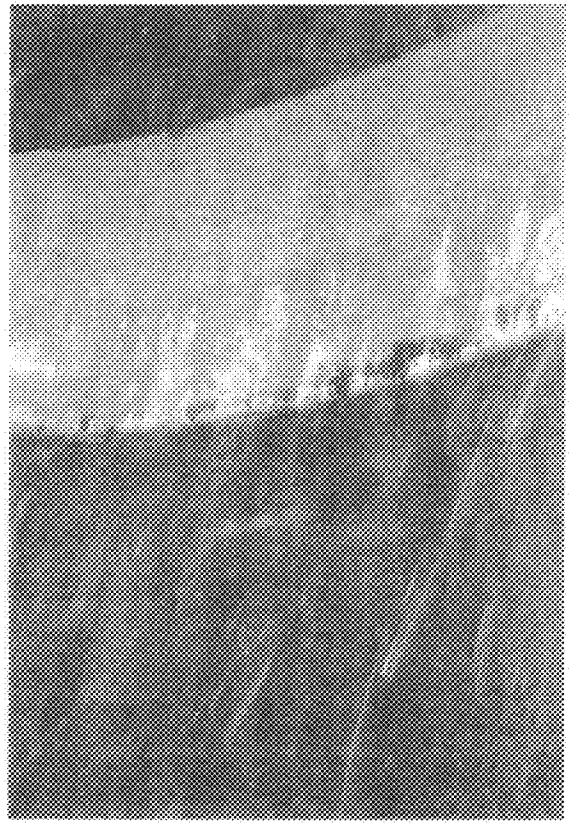
FIG. 22A is a photograph showing a soiled brewery tank prior to cleaning.

FIG. 21B is a photograph of the first tank cleaned with just Trimeta OP after cleaning for 30 minutes. FIG. 22B is a photograph of the second tank cleaned with Trimeta OP and Stabicip Oxi for 40 minutes. As can be seen in these figures, neither tank was completely cleaned after these treatments. When compared to the results of the tank cleanings using a pretreatment/override chemistry, it is clear that the use of the methods of the present invention result in enhanced cleaning.

e) Six Week Fermentation Soil Removal

Figure 23:
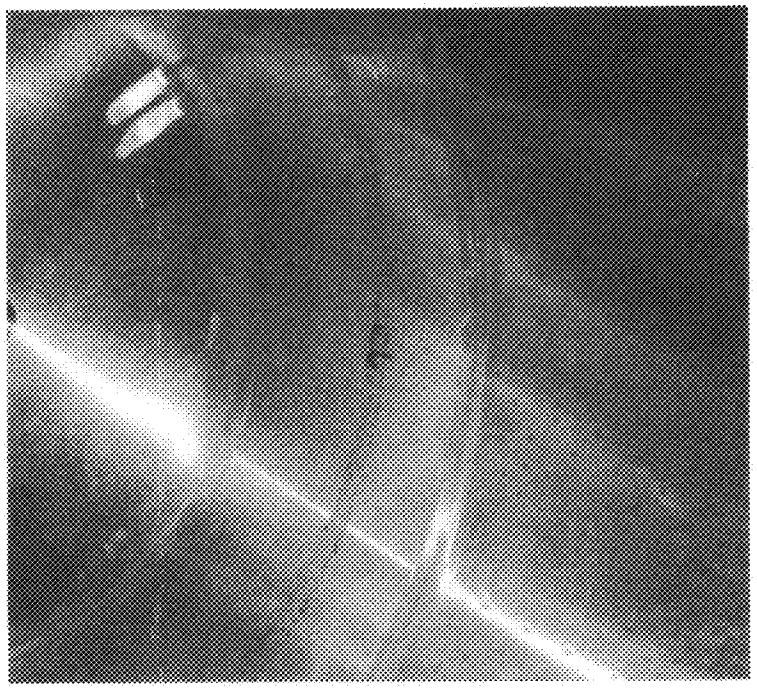
FIG. 23 is two photographs showing a tank with a brandhefe ring before and after cleaning.
Figure 23:
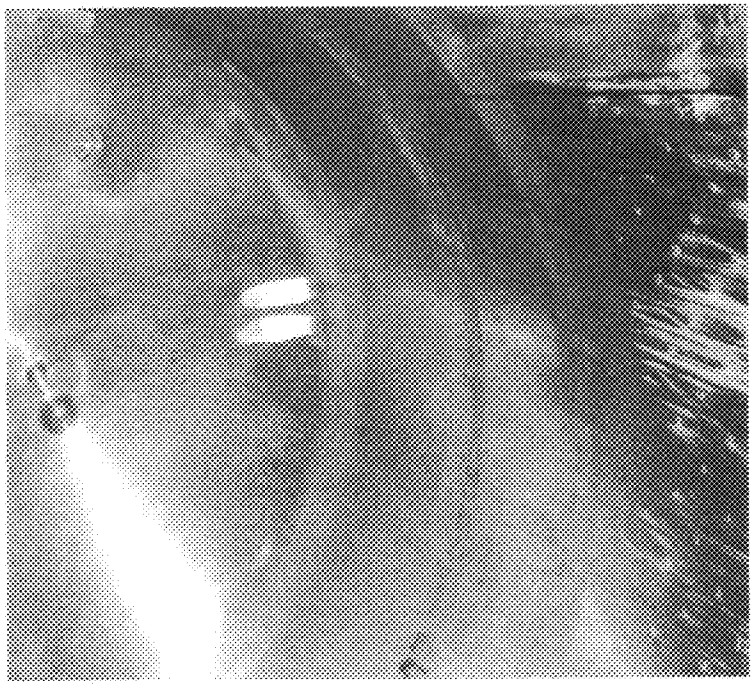

A tank with a brandhefe ring that was the product of a six week fermentation cycle was selected. The tank had been frozen for an unknown period during the end of the fermentation cycle and then rinsed with hot water to thaw the ice layer. A 1% sodium carbonate pre-treatment solution was applied to the surface. An override use solution consisting of Trimeta OP (2%) and 20% sulfuric acid was applied to the surface (to a final pH of about 4.5). During the override, large chunks of soil were observed in the wash solution. FIG. 23 is a photograph showing the tank before cleaning and after cleaning. As can be seen in this figure, there was still some soil remaining on the surface after cleaning. A 1.75% MIP BC was then applied to the surface. 30 minutes of additional cleaning still failed to remove all of the soil.

Although some soil remained after the pre-treatment/override chemistry was applied, the soil remaining was removed with light brushing in less than 5 minutes. The standard method of cleaning these tanks requires an individual to manually scrape and scrub away the remaining soil after CIP. This usually takes 15-20 minutes. Thus, the pre-treatment override chemistry of the present invention did substantially improve the soil removal time compared to conventional cleaning techniques by about 75%.

Example 11—Comparison of Total Time to Clean

The methods of the present invention increase overall cleaning efficacy, i.e., an increase in the amount of soil removed, in a variety of soils. Another measure for cleaning efficacy is the total time to clean a surface. An experiment was run to compare the total clean time using an embodiment of the methods of the present invention to an acid only cleaning treatment, an alkaline only cleaning treatment, and a cleaning treatment using Trimeta PSF a commercially available acid based cleaning treatment.

Stainless steel screens were soiled with 20 grams of ketchup and dried for 45 minutes in an 80° C. oven. The following solutions were prepared in separate beakers at 80° F.: 1% Sodium Bicarbonate; 1.3% Phosphoric Acid; 1.5% NaOH; and 2% Trimeta PSF. A soiled screen was placed in each beaker with 350 rpm stirring. After 15 minutes, a 2% Sulfuric acid override solution was added to the beaker containing the sodium bicarbonate solution. The sulfuric acid override was added to the beaker over the course of 15 minutes. The time to final clean (100% soil removal) was noted for the first screen to be fully cleaned. Table 3 shows the result of this comparison test.

TABLE 3

| Cleaning Treatment | Time to Clean (min) | Percent (%) Clean |
|---|---|---|
| 1% Sodium Bicarbonate with a 2% Sulfuric Acid override | 52 | 100 |
| 1.3% Phosphoric Acid | | 46.5 |
| 1.5% NaOH | | 14.1% |
| 2% Trimeta PSF | | 21.6% |

As can be seen in Table 3, using an embodiment of the present invention, 100% soil removal was achieved at 52 minutes. Conventional cleaning solutions failed to achieve even half as much soil removal in the same period of time. Thus, the methods of the present invention achieve greater than 50% soil removal compared to conventional cleaning techniques in a given period of time.

OTHER EMBODIMENTS

It is to be understood that while the invention has been described in conjunction with the detailed description thereof, the foregoing description is intended to illustrate, and not limit the scope of the invention, which is defined by the scope of the appended claims. Other aspects, advantages, and modifications are within the scope of the following claims.

In addition, the contents of all patent publications discussed supra are incorporated in their entirety by this reference.

It is also to be understood that wherever values and ranges are provided herein, e.g., time, temperature, amount of active ingredients, all values and ranges encompassed by these values and ranges, are meant to be encompassed within the scope of the present invention. Moreover, all values that fall within these ranges, as well as the upper or lower limits of a range of values, are also contemplated by the present application.

What is claimed:

1. A method for removing a soil from an industrial surface using a clean in place (CIP) process, said method comprising:

(a) applying a pretreatment solution comprising an aqueous gas generating use solution comprising a carbon dioxide producing salt selected from the group consisting of sodium carbonate, potassium carbonate, lithium carbonate, ammonium carbonate, calcium carbonate, magnesium carbonate, propylene carbonate, sodium bicarbonate, potassium bicarbonate, ammonium bicarbonate, sodium percarbonate, lithium percarbonate, potassium percarbonate, sodium sesquicarbonate, potassium sesquicarbonate, lithium sesquicarbonate and mixtures thereof in an amount of about 0.2 wt % to about 3.0 wt % to an internal soiled surface of an industrial system component to allow the pre-treatment solution to penetrate the soil;

(b) applying an override use solution comprising an acid selected from the group consisting of phosphoric acid, nitric acid, hydrochloric acid, sulfuric acid, acetic acid, citric acid, lactic acid, formic acid, glycolic acid, sulfamic acid, methanesulfonic acid and mixtures thereof in an amount of between about 1 wt % to about 3 wt % to the internal soiled surface after the pre-treatment solution has been applied to the surface for about 10 minutes, wherein the application of the override use solution activates the pre-treatment solution to generate gas on and in the soil, wherein the gas generated consists of carbon dioxide and is generated in an amount sufficient to provide a soil disruption effect, substantially removing the soil from the surface;

(c) rinsing the surface, wherein the industrial system component is selected from the group consisting of tanks, lines and processing equipment; and further wherein the method removes a greater amount of soil at 70 degrees F. than if the pretreatment solution and the override use solution are applied to the internal soiled surface simultaneously, wherein removing a soil from an industrial surface does not comprise dismantling the system components to clean the internal surface.

2. The method of claim 1, wherein the soil comprises a thermally degraded soil.

3. The method of claim 1, wherein the soil comprises an organic soil selected from the group consisting of a tomato based food soil, a food soil containing reducing sugars, and brewery soils.

4. The method of claim 1, wherein the processing equipment is selected from the group consisting of processing equipment used in the dairy, cheese, brewing, beverage, food, biofuel, sugar, and pharmaceutical manufacturing industries.

5. The method of claim 1, wherein the override use solution lowers the pH of the combination of the pretreatment solution and the override use solution to less than about 7.5.

6. A method for removing soil from an industrial surface using a clean in place (CIP) process, said method comprising:

(a) applying a pretreatment solution comprising an acid selected from the group consisting of phosphoric acid, nitric acid, hydrochloric acid, sulfuric acid, acetic acid, citric acid, lactic acid, formic acid, glycolic acid, sulfamic acid, methanesulfonic acid and mixtures thereof in an amount of between about 1 wt % to about 3 wt % to an internal soiled surface of an industrial system component to allow the pre-treatment solution to penetrate the soil;

(b) applying an override use solution comprising a carbon dioxide gas generating use solution selected from the group consisting of sodium carbonate, potassium carbonate, lithium carbonate, ammonium carbonate, calcium carbonate, magnesium carbonate, propylene carbonate, sodium bicarbonate, potassium bicarbonate, ammonium bicarbonate, sodium percarbonate, lithium percarbonate, potassium percarbonate, sodium sesquicarbonate, potassium sesquicarbonate, lithium sesquicarbonate and mixtures thereof in an amount of about 0.2 wt % to about 3.0 wt % to the surface after the pre-treatment solution has been applied to the surface for about 10 minutes, wherein the application of the override use solution activates the pre-treatment solution to generate gas on and in the soil, wherein the gas generated consists of carbon dioxide and is generated in an amount sufficient to provide a soil disruption effect, substantially removing the soil from the surface; and (c) rinsing the surface, wherein the industrial system component is selected from the group consisting of tanks, lines and processing equipment; and wherein the method removes a greater amount of soil at 70 degrees F. than if the pretreatment solution and the override use solution are applied to the internal soiled surface simultaneously, and further wherein the method of removing soil does not comprise dismantling the system components to clean the internal surface.

7. A method for removing a soil from an industrial surface using a clean in place (CIP) process, said method comprising:

(a) applying a pretreatment solution comprising an aqueous gas generating use solution comprising a carbon dioxide producing salt selected from the group consisting of sodium carbonate, potassium carbonate, calcium carbonate, magnesium carbonate, propylene carbonate, sodium bicarbonate, potassium bicarbonate, and mixtures thereof in an amount of about 0.2 wt % to about 3.0 wt % to an internal soiled surface of an industrial system component to allow the pre-treatment solution to penetrate the soil;

(b) applying an override use solution comprising an acid selected from the group consisting of phosphoric acid, nitric acid, sulfuric acid, methanesulfonic acid and mixtures thereof in an amount of between about 1 wt % to about 3 wt % to the internal soiled surface after the pre-treatment solution has been applied to the surface for about 10 minutes, wherein the application of the override use solution activates the pre-treatment solution to generate gas on and in the soil, wherein the gas generated consists of carbon dioxide and is generated in an amount sufficient to provide a soil disruption effect, substantially removing the soil from the surface;

(c) rinsing the surface, wherein the industrial system component is selected from the group consisting of tanks, lines and processing equipment; and further wherein the method removes a greater amount of soil at 70 degrees F. than if the pretreatment solution and the override use solution are applied to the internal soiled surface simultaneously, wherein removing a soil from an industrial surface does not comprise dismantling the system components to clean the internal surface.

8. The method of claim 7, wherein the soil comprises an organic soil selected from the group consisting of a tomato based food soil, a food soil containing reducing sugars, and brewery soils.

9. The method of claim 7, wherein the processing equipment is selected from the group consisting of processing equipment used in the dairy, cheese, brewing, beverage, food, biofuel, sugar, and pharmaceutical manufacturing industries.

10. The method of claim 7, wherein the override use solution lowers the pH of the combination of the pretreatment solution and the override use solution to less than about 7.5.

11. The method of claim 7, wherein the soil comprises a thermally degraded soil.

* * * * *